US009075350B2

(12) United States Patent
Tanaka et al.

(10) Patent No.: US 9,075,350 B2
(45) Date of Patent: Jul. 7, 2015

(54) IMAGE FORMING APPARATUS TO MAINTAIN ADEQUATE TRANSFERABILITY OF TONER TO A RECORDING MEDIUM

(71) Applicants: Shinya Tanaka, Kanagawa (JP); Hirokazu Ishii, Tokyo (JP); Yasunobu Shimizu, Kanagawa (JP); Keigo Nakamura, Kanagawa (JP)

(72) Inventors: Shinya Tanaka, Kanagawa (JP); Hirokazu Ishii, Tokyo (JP); Yasunobu Shimizu, Kanagawa (JP); Keigo Nakamura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 25 days.

(21) Appl. No.: 14/022,512

(22) Filed: Sep. 10, 2013

(65) Prior Publication Data

US 2014/0079418 A1 Mar. 20, 2014

(30) Foreign Application Priority Data

Sep. 18, 2012 (JP) ..... 2012-205116
May 13, 2013 (JP) ..... 2013-101677

(51) Int. Cl.
*G03G 15/00* (2006.01)
*G03G 15/16* (2006.01)

(52) U.S. Cl.
CPC ..... *G03G 15/16* (2013.01); *G03G 15/1605* (2013.01); *G03G 15/1675* (2013.01); *G03G 2215/00717* (2013.01)

(58) Field of Classification Search
USPC ..... 399/45, 44, 66
See application file for complete search history.

(56) References Cited

U.S. PATENT DOCUMENTS

| | | | |
|---|---|---|---|
| 5,515,146 | A | 5/1996 | Harasawa et al. |
| 5,631,725 | A | 5/1997 | Harasawa et al. |
| 5,812,919 | A | 9/1998 | Takano et al. |
| 5,822,667 | A | 10/1998 | Hayama et al. |
| 5,930,573 | A | 7/1999 | Miyamoto et al. |
| 6,188,862 | B1 | 2/2001 | Ishii |
| 6,282,386 | B1 | 8/2001 | Ishii |
| 2003/0035658 | A1 | 2/2003 | Ishii |

(Continued)

FOREIGN PATENT DOCUMENTS

| | | |
|---|---|---|
| JP | 9-146381 | 6/1997 |
| JP | 2011-013241 | 1/2011 |

(Continued)

OTHER PUBLICATIONS

U.S. Appl. No. 13/785,621, filed Mar. 5, 2013.

(Continued)

*Primary Examiner* — Billy Lactaoen
(74) *Attorney, Agent, or Firm* — Oblon, McClelland, Maier & Neustadt, L.L.P.

(57) ABSTRACT

An image forming apparatus includes a power source to output a voltage having an alternating waveform to transfer a toner image from an image bearing member to a recording medium. A time-averaged value (Vave) of the voltage has a polarity in a transfer direction, in which the toner image is transferred from the image bearing member to the recording medium, and an absolute value of the time-averaged value is greater than a midpoint value (Voff) of the voltage intermediate between a maximum value and a minimum value of the voltage. As a roughness of the recording medium increases, a duty ratio (Duty) expressed by A/(A+B) is reduced, where A is an area of the waveform of the voltage in a return direction opposite the transfer direction relative to the midpoint value in one cycle and B is an area in the transfer direction relative to the midpoint value.

13 Claims, 12 Drawing Sheets

(56) References Cited

U.S. PATENT DOCUMENTS

| | | | | |
|---|---|---|---|---|
| 2005/0180767 | A1 | 8/2005 | Ishii et al. | |
| 2007/0003333 | A1 | 1/2007 | Ishii | |
| 2007/0014597 | A1 | 1/2007 | Ishii | |
| 2007/0127941 | A1 | 6/2007 | Ishii et al. | |
| 2010/0008687 | A1 | 1/2010 | Ishii | |
| 2010/0329707 | A1* | 12/2010 | Yamada | 399/44 |
| 2011/0229168 | A1 | 9/2011 | Shiraishi et al. | |
| 2012/0008991 | A1 | 1/2012 | Shimizu | |
| 2012/0045231 | A1* | 2/2012 | Ogino et al. | 399/45 |
| 2012/0045237 | A1 | 2/2012 | Aoki et al. | |
| 2012/0045259 | A1 | 2/2012 | Nakamura et al. | |
| 2012/0170951 | A1 | 7/2012 | Ishii | |
| 2012/0230715 | A1 | 9/2012 | Ogino et al. | |
| 2012/0237234 | A1 | 9/2012 | Sugimoto et al. | |
| 2012/0237271 | A1 | 9/2012 | Sengoku et al. | |
| 2012/0243892 | A1 | 9/2012 | Nakamura et al. | |
| 2012/0308250 | A1 | 12/2012 | Shimizu et al. | |
| 2012/0315058 | A1 | 12/2012 | Shimizu et al. | |
| 2012/0328314 | A1 | 12/2012 | Sugimoto et al. | |
| 2012/0328315 | A1 | 12/2012 | Takeuchi et al. | |
| 2012/0328320 | A1 | 12/2012 | Fujita et al. | |
| 2012/0328321 | A1 | 12/2012 | Takeuchi et al. | |
| 2013/0004190 | A1 | 1/2013 | Sengoku et al. | |
| 2013/0011155 | A1 | 1/2013 | Ogiyama et al. | |
| 2013/0016989 | A1 | 1/2013 | Fujita et al. | |
| 2013/0064559 | A1 | 3/2013 | Nakamura et al. | |
| 2013/0089363 | A1 | 4/2013 | Mimbu et al. | |
| 2013/0094870 | A1 | 4/2013 | Shimizu et al. | |
| 2013/0121714 | A1 | 5/2013 | Tanaka et al. | |
| 2013/0136468 | A1 | 5/2013 | Shimizu et al. | |
| 2013/0136477 | A1 | 5/2013 | Ogiyama et al. | |
| 2013/0142531 | A1 | 6/2013 | Sugimoto et al. | |
| 2013/0148993 | A1 | 6/2013 | Aoki et al. | |
| 2013/0164011 | A1 | 6/2013 | Nakamura et al. | |
| 2013/0177329 | A1 | 7/2013 | Tanaka et al. | |
| 2013/0195483 | A1 | 8/2013 | Shimizu et al. | |
| 2013/0216281 | A1 | 8/2013 | Suzuki et al. | |

FOREIGN PATENT DOCUMENTS

| | | |
|---|---|---|
| JP | 2012-042827 | 3/2012 |
| JP | 2012-042832 | 3/2012 |
| WO | WO 2012/128373 A1 | 9/2012 |

OTHER PUBLICATIONS

U.S. Appl. No. 13/871,115, filed Apr. 26, 2013.
U.S. Appl. No. 13/893,594, filed May 14, 2013.
U.S. Appl. No. 13/918,088, filed Jun. 14, 2013.

* cited by examiner

FIG. 18

| | SHEET TYPE | DEPTH OF RECESS (μm) |
|---|---|---|
| | ZetaHammer 100g | 48 |
| | LEATHAC 100g | 85 |
| | LEATHAC 130kg | 101 |
| | LEATHAC 175kg | 112 |

FIG. 19

| | | Vpp (kV) | duty (%) | Vave (kV) | TRANSFERABILITY AT RECESS | ELECTRICAL DISCHARGE |
|---|---|---|---|---|---|---|
| COMPARATIVE EXAMPLE | LEATHAC 100g | 8 | 20 | -3.40 | 3 | 1 |
| | LEATHAC 130kg | 8 | 20 | -3.40 | 3 | 3 |
| | LEATHAC 175kg | 8 | 20 | -3.40 | 1 | 4 |
| EMBODIMENT | LEATHAC 100g | 8 | 30 | -2.60 | 3 | 3 |
| | LEATHAC 130kg | 8 | 20 | -3.40 | 3 | 3 |
| | LEATHAC 175kg | 8 | 12 | -4.04 | 3 | 4 |

FIG. 20

| | TEMPERATURE/ HUMIDITY | Vpp (kV) | duty (%) | Vave (kV) | TRANSFERABILITY AT RECESS | ELECTRICAL DISCHARGE |
|---|---|---|---|---|---|---|
| COMPARATIVE EXAMPLE | 10°C 15% | 8 | 20 | -3.40 | 1 | 4 |
| | 23°C 50% | 8 | 20 | -3.40 | 3 | 3 |
| | 27°C 80% | 8 | 20 | -3.40 | 3 | 1 |
| EMBODIMENT | 10°C 15% | 8 | 12 | -4.04 | 3 | 4 |
| | 23°C 50% | 8 | 20 | -3.40 | 3 | 3 |
| | 27°C 80% | 8 | 30 | -2.60 | 3 | 4 |

FIG. 21

| | RESISTANCE OF PARTS (log Ω) | Vpp (kV) | duty (%) | Vave (kV) | TRANSFERABILITY AT RECESS | ELECTRICAL DISCHARGE |
|---|---|---|---|---|---|---|
| COMPARATIVE EXAMPLE | 8.0 | 8 | 20 | −3.40 | 1 | 4 |
| | 7.5 | 8 | 20 | −3.40 | 3 | 3 |
| | 7.0 | 8 | 20 | −3.40 | 3 | 1 |
| EMBODIMENT | 8.0 | 8 | 12 | −4.04 | 3 | 3 |
| | 7.5 | 8 | 20 | −3.40 | 3 | 3 |
| | 7.0 | 8 | 30 | −2.60 | 3 | 4 |

FIG. 22

| | | Vpp (kV) | Vave (kV) | duty (%) | Vr (kV) | Vt (kV) | TRANSFERABILITY AT RECESS | ELECTRICAL DISCHARGE |
|---|---|---|---|---|---|---|---|---|
| COMPARATIVE EXAMPLE | ZetaHammer 100g | 5 | −0.6 | 20 | 3.40 | −1.60 | 4 | 2 |
| | LEATHAC 100g | 6 | −1.0 | 20 | 3.80 | −2.20 | 4 | 2 |
| | LEATHAC 130kg | 8 | −2.0 | 20 | 4.40 | −3.60 | 4 | 3 |
| | LEATHAC 175kg | 10 | −4.0 | 20 | 4.00 | −6.00 | 4 | 2 |
| EMBODIMENT | ZetaHammer 100g | 5 | −0.6 | 38 | 2.50 | −2.50 | 5 | 5 |
| | LEATHAC 100g | 6 | −1.0 | 33 | 3.02 | −2.98 | 5 | 5 |
| | LEATHAC 130kg | 8 | −2.0 | 25 | 4.00 | −4.00 | 5 | 5 |
| | LEATHAC 175kg | 10 | −4.0 | 10 | 5.00 | −5.00 | 5 | 4 |

FIG. 23

| | TEMPERATURE /HUMIDITY | Vpp (kV) | Vave (kV) | duty (%) | Vr (kV) | Vt (kV) | TRANSFERABILITY AT RECESS | ELECTRICAL DISCHARGE |
|---|---|---|---|---|---|---|---|---|
| COMPARATIVE EXAMPLE | 10°C 15% | 10 | −4 | 20 | 4.00 | −6.00 | 4 | 2 |
| | 23°C 50% | 8 | −3 | 20 | 3.40 | −4.60 | 5 | 3 |
| | 27°C 80% | 6 | −2 | 20 | 2.80 | −3.20 | 5 | 2 |
| EMBODIMENT | 10°C 15% | 10 | −4 | 10 | 5.00 | −5.00 | 5 | 4 |
| | 23°C 50% | 8 | −3 | 12 | 4.04 | −3.96 | 5 | 5 |
| | 27°C 80% | 6 | −2 | 15 | 3.10 | −2.90 | 5 | 5 |

FIG. 24

| | RESISTANCE OF PARTS (log Ω) | Vpp (kV) | Vave (kV) | duty (%) | Vr (kV) | Vt (kV) | TRANSFERABILITY AT RECESS | ELECTRICAL DISCHARGE |
|---|---|---|---|---|---|---|---|---|
| COMPARATIVE EXAMPLE | 8.0 | 10 | −4 | 20 | 4.00 | −6.00 | 4 | 1 |
| | 7.5 | 8 | −3 | 20 | 3.40 | −4.60 | 5 | 2 |
| | 7.0 | 6 | −2 | 20 | 2.80 | −3.20 | 5 | 3 |
| EMBODIMENT | 8.0 | 10 | −4 | 10 | 5.00 | −5.00 | 5 | 5 |
| | 7.5 | 8 | −3 | 12 | 4.04 | −3.96 | 5 | 5 |
| | 7.0 | 6 | −2 | 15 | 3.10 | −2.90 | 5 | 5 |

IMAGE FORMING APPARATUS TO MAINTAIN ADEQUATE TRANSFERABILITY OF TONER TO A RECORDING MEDIUM

CROSS-REFERENCE TO RELATED APPLICATIONS

This patent application is based on and claims priority pursuant to 35 U.S.C. §119 from Japanese Patent Application Nos. 2012-205116, filed on Sep. 18, 2012, and 2013-101677, filed on May 13, 2013, both in the Japan Patent Office, which are hereby incorporated herein by reference in their entirety.

BACKGROUND

1. Technical Field

Exemplary aspects of the present disclosure generally relate to an image forming apparatus including an image bearing member and a transfer device contacting the image bearing member to form a transfer nip therebetween, and a toner image formed on the image bearing member is transferred onto a recording medium fed to the transfer nip.

2. Description of the Related Art

In known electrophotographic image forming apparatuses, an unfixed image, known as a toner image, is formed on an image bearing member, i.e., a photosensitive drum. An intermediate transfer member, i.e., an intermediate transfer belt serving also as an image bearing member, contacts the photosensitive drum to form a so-called primary transfer nip therebetween. In the primary transfer nip, the toner image on the photosensitive drum is primarily transferred onto the intermediate transfer belt.

A secondary transfer roller serving as a transfer device contacts the intermediate transfer belt to form a so-called secondary transfer nip. An opposed roller is disposed inside the loop formed by the intermediate transfer belt, facing the secondary transfer roller with the intermediate transfer belt interposed therebetween. The opposed roller disposed inside the loop of the intermediate transfer belt is grounded; whereas, the secondary transfer roller disposed outside the loop is supplied with a secondary transfer bias (voltage). In this configuration, a secondary transfer electric field is formed in a secondary transfer nip between the opposed roller and the secondary transfer roller. The secondary transfer electric field causes the toner image to move from the opposed roller side to the secondary transfer roller side.

A recording medium is fed to the secondary transfer nip in appropriate timing such that the recording medium is aligned with the toner image formed on the intermediate transfer belt. Due to the secondary transfer electric field and a nip pressure applied to the secondary transfer nip, the toner image on the intermediate transfer belt is transferred secondarily onto the recording medium.

In such a configuration described above, when using a recording medium having a coarse surface such as Japanese paper (also known as Washi), a pattern of light and dark according to the surface condition of the recording medium appears in an output image because toner does not transfer well to such an embossed surface, in particular, recessed portions of the surface. As a result, the image density at the recessed portions is lower than the image density at projecting portions. This inadequate transfer of the toner appears as the pattern of light and dark patches in the resulting output image.

In view of the above, in one approach, not only a direct current (DC) voltage, but also a DC voltage superimposed on an alternating current (AC) voltage is applied as a secondary transfer bias, thereby preventing the pattern of light and dark, as compared with supplying only the direct current voltage.

According to experiments performed by the present inventors, the present inventors have recognized that application of the secondary transfer bias as described above causes easily white spots (absence of toner) in an image on the recessed portions of the recording medium. This phenomenon also depends on the degree of roughness of the recording medium, temperature and humidity, electrical resistance at the transfer nip, and so forth.

In view of the above, there is thus an unsolved need for an image forming apparatus capable of maintaining good transferability regardless of surface conditions of recording media.

SUMMARY

In view of the foregoing, in an aspect of this disclosure, there is provided a novel image forming apparatus including an image bearing member, a transfer member, a power source, and a controller. The image bearing member bears a toner image on a surface thereof. The transfer member is disposed opposite the image bearing member and contacts the surface of the image bearing member to form a transfer nip. The power source outputs a voltage to transfer the toner image from the image bearing member onto a recording medium interposed in the transfer nip. The voltage includes a first voltage in a transfer direction in which the toner image is transferred from the image bearing member to the recording medium and a second voltage having a polarity opposite that of the first voltage. The first voltage and the second voltage alternate upon transfer of the toner image from the image bearing member to the recording medium. The controller is operatively connected to the power source, to control the power source. A time-averaged value (Vave) of the voltage has a polarity in the transfer direction, and an absolute value of the time-averaged value (Vave) is greater than a midpoint value (Voff) of the voltage intermediate between a maximum value and a minimum value of the voltage. As a roughness of the recording medium increases, the controller controls the power source to reduce a duty ratio (Duty) expressed by A/(A+B), where A is an area of an alternating waveform in a return direction opposite the transfer direction relative to the midpoint value Voff in one cycle and B is an area in the transfer direction relative to the midpoint value Voff.

According to another aspect, an image forming apparatus includes an image bearing member, a transfer member, a power source, a controller, and an environment detector. The image bearing member bears a toner image on a surface thereof. The transfer member is disposed opposite the image bearing member and contacts the surface of the image bearing member to form a transfer nip. The power source outputs a voltage to transfer the toner image on the image bearing member onto a recording medium interposed in the transfer nip. The voltage includes a first voltage in a transfer direction in which the toner image is transferred from the image bearing member to the recording medium and a second voltage having a polarity opposite that of the first voltage. The first voltage and the second voltage alternate upon transfer of the toner image from the image bearing member to the recording medium. The controller is operatively connected to the power source, to control the power source. The environment detector detects at least one of temperature and humidity. A time-averaged value (Vave) of the voltage has a polarity in the transfer direction, and an absolute value of the time-averaged value (Vave) is greater than a midpoint value (Voff) of the voltage intermediate between a maximum value and a minimum value of the voltage. As at least one of the temperature and the humidity detected by the environment detector decreases, the controller controls the power source to reduce a duty ratio (Duty) expressed by A/(A+B), where A is an area of an alternating waveform in a return direction opposite the transfer direction relative to the midpoint value Voff in one cycle and B is an area in the transfer direction relative to the midpoint value Voff.

According to another aspect, an image forming apparatus includes an image bearing member, a transfer member, a power source, a controller, and a resistance detector. The image bearing member bears a toner image on a surface thereof. The transfer member is disposed opposite the image bearing member and contacts the surface of the image bearing member to form a transfer nip. The power source outputs a voltage to transfer the toner image on the image bearing member onto a recording medium interposed in the transfer nip. The voltage includes a first voltage in a transfer direction in which the toner image is transferred from the image bearing member to the recording medium and a second voltage having a polarity opposite that of the first voltage. The first voltage and the second voltage alternate upon transfer of the toner image from the image bearing member to the recording medium. The controller is operatively connected to the power source, to control the power source. The resistance detector detects an electrical resistance of a transfer section including the image bearing member and the transfer member. A time-averaged value (Vave) of the voltage has a polarity in the transfer direction, and an absolute value of the time-averaged value (Vave) is greater than a midpoint value (Voff) of the voltage intermediate between a maximum value and a minimum value of the voltage. As an electrical resistance detected by the resistance detector increases, the controller controls the power source to reduce a duty ratio (Duty) expressed by A/(A+B), where A is an area of an alternating waveform in a return direction opposite the transfer direction relative to the midpoint value Voff in one cycle and B is an area in the transfer direction relative to the midpoint value Voff.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein:

FIG. 18 is a table showing a relation of a sheet type and a degree of roughness of recording media used in illustrative embodiments;

FIG. 19 is a table showing effects of Embodiment 1 in which the sheet type and a duty ratio (Duty) are varied;

FIG. 20 is a table showing effects of Embodiment 2 in which temperature, humidity, and the duty ratio (Duty) are varied;

FIG. 21 is a table showing effects of Embodiment 3 in which electrical resistance of a transfer section and the duty ratio (Duty) is varied;

FIG. 22 is a table showing effects of Embodiment 4 in which the sheet type, the duty ratio (Duty), and a peak-to-peak voltage (Vpp) are varied;

FIG. 23 is a table showing effects of Embodiment 5 in which temperature, humidity, the duty ratio (Duty), and the peak-to-peak voltage (Vpp) are varied; and FIG. 24 is a table showing effects of Embodiment 6 in which the electrical resistance at the transfer section, the duty ratio (Duty), and the peak-to-peak voltage are varied.

DETAILED DESCRIPTION

Figure 1:
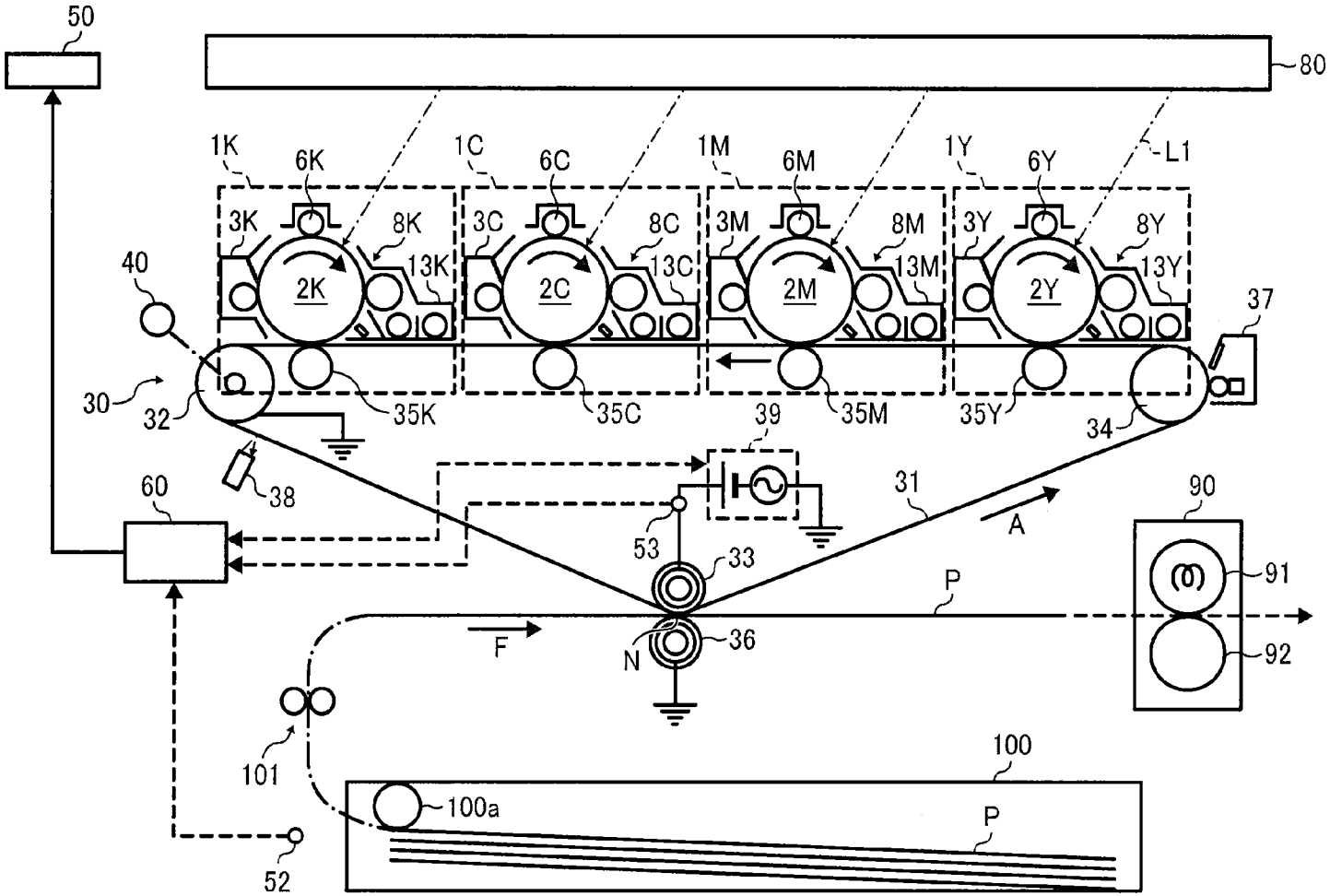
FIG. 1 is a schematic diagram illustrating an image forming apparatus according to an illustrative embodiment of the present disclosure.

A description is now given of illustrative embodiments of the present disclosure. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, and initially with reference to FIG. 1, a description is provided of an electrophotographic color printer as an example of an image forming apparatus according to an illustrative embodiment of the present disclosure.

FIG. 1 is a schematic diagram illustrating the image forming apparatus. As illustrated in FIG. 1, the image forming apparatus includes four image forming units 1Y, 1M, 1C, and 1K for forming toner images, one for each of the colors yellow, magenta, cyan, and black, respectively, a transfer unit 30, an optical writing unit 80, a fixing device 90, a sheet cassette 100, a pair of registration rollers 101, and a controller 60. It is to be noted that the suffixes Y, M, C, and K denote colors yellow, magenta, cyan, and black, respectively. To simplify the description, these suffixes Y, M, C, and K indicating colors are omitted herein, unless otherwise specified.

The image forming units 1Y, 1M, 1C, and 1K all have the same configuration as all the others, differing only in the color of toner employed. Thus, a description is provided of the image forming unit 1K for forming a toner image of black as a representative example of the image forming units. The image forming units 1Y, 1M, 1C, and 1K are replaced upon reaching their product life cycles.

Figure 2:
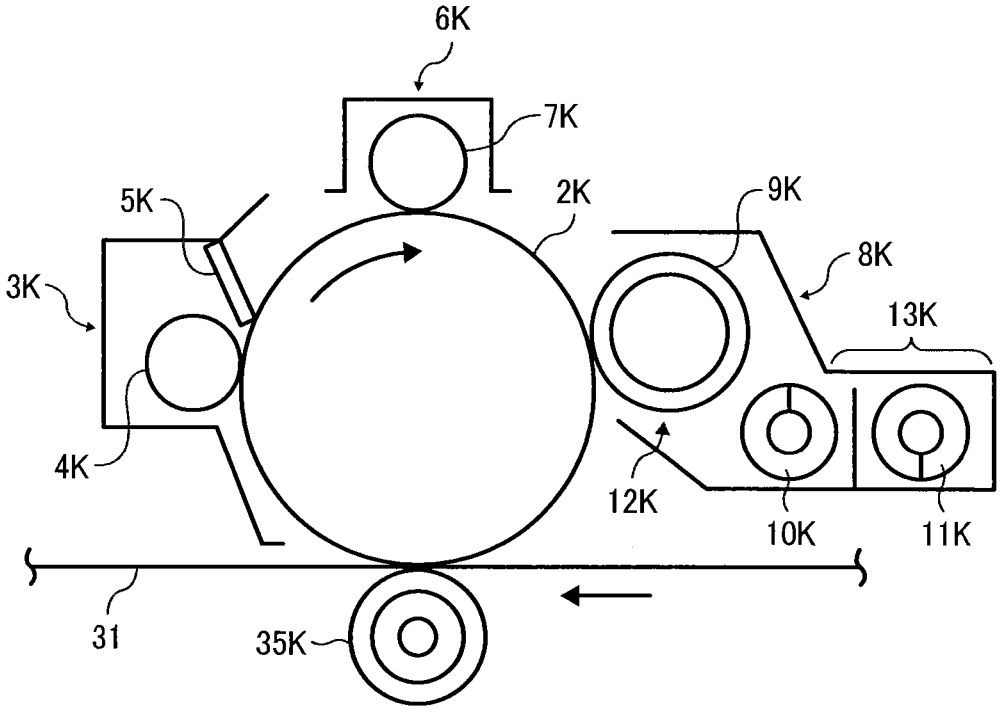
FIG. 2 is a schematic diagram illustrating an image forming unit for black as an example of image forming units employed in the image forming apparatus of FIG. 1.

With reference to FIG. 2, a description is provided of the image forming unit 1K as an example of the image forming units. FIG. 2 is a schematic diagram illustrating the image forming unit 1K. As illustrated in FIG. 2, the image forming unit 1K for forming a black toner image includes a drum-shaped photosensitive drum 2K (hereinafter referred to as photosensitive drum) serving as a latent image bearing member, a charging device 6K, a developing device 8K, a drum cleaning device 3K, and so forth. These devices are held in a common holder so that they are detachably attachable and replaced at the same time.

Similar to the image forming unit 1K, the image forming units 1Y, 1M, and 1C include photosensitive drums 2Y, 2M, and 2C, respectively. The photosensitive drums 2Y, 2M, and 2C are surrounded by charging devices 6Y, 6M, and 6C, developing devices 8Y, 8M, and 8C, drum cleaning devices 3Y, 3M, and 3C, respectively.

The photosensitive drum 2K is formed of a drum-shaped base on which an organic photosensitive layer is disposed. The photosensitive drum 2K is rotated in a clockwise direction by a driving device. The charging device 6K includes a charging roller 7K supplied with a charging bias. The charging roller 7K contacts or approaches the photosensitive drum 2K to generate an electric discharge therebetween, thereby charging uniformly the surface of the photosensitive drum 2K.

According to the present illustrative embodiment, the photosensitive drum 2K is uniformly charged with a negative polarity which is the same polarity as the normal charge polarity of the toner. More specifically, the photosensitive drum 2K is charged uniformly at approximately −650 [V]. According to the present illustrative embodiment, an alternating current (AC) voltage superimposed on a direct current (DC) voltage is employed as a charging bias. The charging roller 7K comprises a metal cored bar coated with a conductive elastic layer made of a conductive elastic material. According to the present embodiment, the photosensitive drum 2K is charged by the charging roller 7K contacting the photosensitive drum 2K or disposed near the photosensitive drum 2K. Alternatively, a corona charger may be employed.

The uniformly charged surface of the photosensitive drum 2K is scanned by a light beam projected from the optical writing unit 80, thereby forming an electrostatic latent image for black on the surface of the photosensitive drum 2K. The potential of the electrostatic latent image for black is approximately −100 V. The electrostatic latent image for black on the photosensitive drum 2K is developed with black toner by the developing device 8K. Accordingly, a visible image, also known as a toner image of black, is formed on the photosensitive drum 2K. As will be described later in detail, the toner image is transferred primarily onto an intermediate transfer belt 31.

The drum cleaning device 3K removes residual toner remaining on the photosensitive drum 2K after a primary transfer process, that is, after the photosensitive drum 2K passes through a primary transfer nip between the intermediate transfer belt 31 and the photosensitive drum 2K. The drum cleaning device 3K includes a cleaning blade 5K and a brush roller 4K which is rotated. The cleaning blade 5K is cantilevered, that is, one end thereof is fixed to the housing of the drum cleaning device 3K, and the other end is free and contacts the surface of the photosensitive drum 2K. The brush roller 4K rotates and brushes off the residual toner from the surface of the photosensitive drum 2K while the cleaning blade 5K removes the residual toner by scraping. It is to be noted that the cantilevered side of the cleaning blade 5K is positioned downstream from its free end contacting the photosensitive drum 2K in the direction of rotation of the photosensitive drum 2K so that the free end of the cleaning blade 5K faces or becomes counter to the direction of rotation.

A charge neutralizer removes residual charge remaining on the photosensitive drum 2K after the surface thereof is cleaned by the drum cleaning device 3K in preparation for the subsequent imaging cycle. The surface of the photosensitive drum 2K is initialized.

The developing device 8K includes a developing section 12K and a developer conveyer 13K. The developing section 12K includes a developing roller 9K inside thereof. The developer conveyer 13K transports a developing agent for black while mixing the developing agent. The developer conveyer 13K includes a first chamber equipped with a first screw 10K and a second chamber equipped with a second screw 11K. The first screw 10K and the second screw 11K are each constituted of a rotatable shaft and helical flighting wrapped around the circumferential surface of the shaft. Each end of the shaft of the first screw 10K and the second screw 11K in the axial direction is rotatably held by shaft bearings.

The first chamber with the first screw 10K and the second chamber with the second screw 11K are separated by a wall, but each end of the wall in the direction of the screw shaft has a connecting hole through which the first chamber and the second chamber communicate. The first screw 10K mixes the developing agent by rotating the helical flighting and carries the developing agent from the distal end to the proximal end of the screw in the direction perpendicular to the surface of the recording medium while rotating. The first screw 10K is disposed parallel to and facing the developing roller 9K. The developing agent is delivered along the axial (shaft) direction of the developing roller 9K. The first screw 10K supplies the developing agent to the surface of the developing roller 9K along the direction of the shaft line of the developing roller 9K.

The developing agent conveyed near the proximal end of the first screw 10K passes through the connecting hole in the wall near the proximal side and enters the second chamber. Subsequently, the developing agent is carried by the helical fighting of the second screw 11K. As the second screw 11K rotates, the developing agent is delivered from the proximal end to the distal end in FIG. 2 while being mixed in the direction of rotation.

In the second chamber, a toner density detector for detecting the density of the toner in the developing agent is disposed at the bottom of a casing of the chamber. As the toner density detector, a magnetic permeability detector is employed. There is a correlation between the toner density and a magnetic permeability of the developing agent consisting of toner particles and magnetic carriers. Therefore, the magnetic permeability detector can detect the density of the toner.

Although not illustrated, the image forming apparatus includes toner supply devices to independently supply toner of yellow, magenta, cyan, and black to the second chamber of the respective developing device. The controller 60 of the image forming apparatus includes a Random Access Memory (RAM) to store a target output voltage Vtref for each output voltage provided by the toner density detectors for yellow, magenta, cyan, and black. If the difference between each output voltage provided by the toner detectors and Vtref for each color exceeds a predetermined value, the toner supply devices are activated. Accordingly, the respective color of toner is supplied to the second chamber of the developing device.

The developing roller 9K in the developing section 12K faces the first screw 10K as well as the photosensitive drum 2K through an opening formed in the casing of the developing device 8K. The developing roller 9K is comprised of a cylindrical developing sleeve made of a non-magnetic pipe which is rotated, and a magnetic roller disposed inside the developing sleeve. The magnetic roller is fixed to prevent the magnetic roller from rotating together with the developing sleeve. The developing agent supplied from the first screw 10K is borne on the surface of the developing sleeve due to the magnetic force of the magnetic roller. As the developing sleeve rotates, the developing agent is transported to a developing area facing the photosensitive drum 2K.

The developing sleeve is supplied with a developing bias having the same polarity as toner. The developing bias is greater than the bias of the electrostatic latent image on the photosensitive drum 2K, but less than the charging potential of the uniformly charged photosensitive drum 2K. With this configuration, a developing potential that causes the toner on the developing sleeve to move electrostatically to the electrostatic latent image on the photosensitive drum 2K acts between the developing sleeve and the electrostatic latent image on the photosensitive drum 2K.

A non-developing potential acts between the developing sleeve and the non-image formation areas of the photosensitive drum 2K, causing the toner on the developing sleeve to move to the sleeve surface. Due to the developing potential and the non-developing potential, the toner on the developing sleeve moves selectively to the electrostatic latent image formed on the photosensitive drum 2K, thereby forming a visible image, known as a toner image.

In FIG. 1, similar to the image forming unit 1K, in the image forming units 1Y, 1M, and 1C, toner images of yellow, magenta, and cyan are formed on the photosensitive drums 2Y, 2M, and 2C, respectively.

The optical writing unit 80 for writing a latent image on the photosensitive drums 2Y, 2M, 2C, and 2K is disposed above the image forming units 1Y, 1M, 1C, and 1K. Based on image information provided by external devices such as a personal computer (PC), the optical writing unit 80 illuminates the photosensitive drums 2Y, 2M, 2C, and 2K with a light beam projected from a light source, for example, a laser diode of the optical writing unit 80. Accordingly, electrostatic latent images of yellow, magenta, cyan, and black are formed on the photosensitive drums 2Y, 2M, 2C, and 2K, respectively. More specifically, the potential of the portion of the charged surface of the photosensitive drum 2 illuminated with the light beam is attenuated. The potential of the illuminated portion of the photosensitive drum 11 with the light beam is less than the potential of the other area, that is, a background portion (non-image formation area), thereby forming an electrostatic latent image on the surface of the photosensitive drum 11.

The optical writing unit 80 includes a polygon mirror, a plurality of optical lenses, and mirrors. The light beam projected from the laser diode serving as a light source is deflected in a main scanning direction by the polygon mirror rotated by a polygon motor. The deflected light, then, strikes the optical lenses and mirrors, thereby scanning each of the photosensitive drums. Alternatively, the optical writing unit 80 may employ a light source using an LED array including a plurality of LEDs that projects light.

Referring back to FIG. 1, a description is provided of the transfer unit 30. The transfer unit 30 is disposed below the image forming units 1Y, 1M, 1C, and 1K. The transfer unit 30 includes the intermediate transfer belt 31 as an image bearing member formed into an endless loop and entrained about a plurality of rollers, thereby being moved endlessly in the counterclockwise direction indicated by arrow A. The transfer unit 30 also includes a drive roller 32, an opposed roller 33, a cleaning backup roller 34, a nip forming roller 36, a belt cleaning device 37, four primary transfer rollers 35Y, 35M, 35C, and 35K as transfer devices, and so forth.

The intermediate transfer belt 31 is entrained around and stretched taut between the drive roller 32, the opposed roller 33, the cleaning backup roller 34, and the primary transfer rollers 35Y, 35M, 35C, and 35K (which may be collectively referred to as the primary transfer rollers 35, unless otherwise specified.) The drive roller 32 is rotated in the counterclockwise direction by a driving device such as a motor, and rotation of the drive roller 32 enables the intermediate transfer belt 31 to rotate in the same direction indicated by an arrow A in FIG. 1.

The intermediate transfer belt 31 is interposed between the photosensitive drums 35Y, 35M, 35C, and 35K, and the photosensitive drums 2Y, 2M, 2C, and 2K. Accordingly, primary transfer nips are formed between the front surface (image bearing surface) of the intermediate transfer belt 31 and the photosensitive drums 2Y, 2M, 2C, and 2K. The primary transfer rollers 35Y, 35M, 35C, and 35K are supplied with a primary bias supplied by a primary-transfer power source 81 (illustrated in FIG. 16), thereby generating a transfer electric field between each of the toner images on the photosensitive drums 2Y, 2M, 2C, and 2K, and the primary transfer rollers 35Y, 35M, 35C, and 35K.

The yellow toner image formed on the photosensitive drum 2Y enters the primary transfer nip as the photosensitive drum 2Y rotates. Subsequently, the yellow toner image is transferred primarily from the photosensitive drum 2Y to the intermediate transfer belt 31 by the transfer electrical field and the nip pressure. This process is known as primary transfer. The intermediate transfer belt 31, on which the toner image of yellow has been transferred, passes through the primary transfer nips of magenta, cyan, and black.

The toner images on the photosensitive drums 2M, 2C, and 2K are superimposed on the yellow toner image which has been transferred on the intermediate transfer belt 31, thereby forming a composite toner image on the intermediate transfer belt 31 in the primary transfer process. Accordingly, a composite toner image with the toner images of yellow, magenta, cyan, and black superimposed on one another is formed on the surface of the intermediate transfer belt 31.

Each of the primary transfer rollers 35Y, 35M, 35C, and 35K is constituted of an elastic roller including a metal cored bar on which a conductive sponge layer is fixated. The shaft center of each of the shafts of the primary transfer rollers 35Y, 35M, 35C, and 35K is positioned approximately 2.5 mm off from the shaft center of the shafts of the photosensitive drums 2Y, 2M, 2C, and 2K toward the downstream side in the direction of movement of the intermediate transfer belt 31. According to the present illustrative embodiment, the primary transfer rollers 35Y, 35M, 35C, and 35K described above are supplied with a primary transfer bias under constant current control. According to the present illustrative embodiment, roller-type primary transfer devices, that is, the primary transfer rollers 35Y, 35M, 35C, and 35K, are employed as primary transfer devices. Alternatively, a transfer charger and a brush-type transfer device may be employed as the primary transfer device.

The nip forming roller 36 of the transfer unit 30 is disposed outside the loop formed by the intermediate transfer belt 31, opposite the opposed roller 33. The intermediate transfer belt 31 is interposed between the opposed roller 33 and the nip forming roller 36, thereby forming a secondary transfer nip N at which the front surface of intermediate transfer belt 31 contacts the nip forming roller 36. In the example shown in FIGS. 1 and 2, the nip forming roller 36 is grounded. The opposed roller 33 disposed inside the looped belt is supplied with a secondary transfer bias supplied from a power source 39 for a secondary transfer bias. With this configuration, a secondary transfer electric field to electrostatically transfer the toner of negative polarity from the opposed roller 33 side to the nip forming roller 36 side is formed between the opposed roller 33 and the nip forming roller 36.

As illustrated in FIG. 1, the sheet cassette 100 storing a stack of recording media P is disposed substantially below the transfer unit 30. The sheet cassette 100 is equipped with a sheet feed roller 100*a* to contact a top sheet of the stack of recording media P. As the sheet feed roller 100*a* is rotated at a predetermined speed, the sheet feed roller 101*a* picks up the top sheet and feeds it to a sheet passage in the image forming apparatus. Substantially at the end of the sheet passage, the pair of registration rollers 101 is disposed.

The pair of the registration rollers 101 stops rotating temporarily, immediately after the recording medium P delivered from the sheet cassette 100 is interposed therebetween. The pair of registration rollers 101 starts to rotate again to feed the recording medium P to the secondary transfer nip N in appropriate timing such that the recording medium P is aligned with the composite toner image formed on the intermediate transfer belt 31 in the secondary transfer nip N.

In the secondary transfer nip N, the recording medium P tightly contacts the composite toner image on the intermediate transfer belt 31, and the composite toner image is transferred onto the recording medium P by the secondary transfer electric field and the nip pressure applied thereto. The recording medium P, on which the composite color toner image is formed, passes through the secondary transfer nip N and separates from the nip forming roller 36 and the intermediate transfer belt 31 due to the curvature.

The opposed roller 33 is constituted of a metal cored bar on which a conductive nitrile rubber (NBR) layer is disposed. The nip forming roller 36 is formed of a metal cored bar on which the conductive NBR rubber layer is disposed.

The power source 39 outputs a voltage to transfer the toner image from the intermediate transfer belt 31 to the recording medium P interposed in the secondary transfer nip N. The secondary-transfer bias power source 39 includes a direct current (DC) power source and an alternating current (AC) power source, and can output a superimposed bias as the secondary transfer bias in which an AC voltage is superimposed on a DC voltage. According to the present illustrative embodiment as shown in FIG. 1, the nip forming roller 36 is grounded while the secondary transfer bias is applied to the opposed roller 33.

Figure 3:
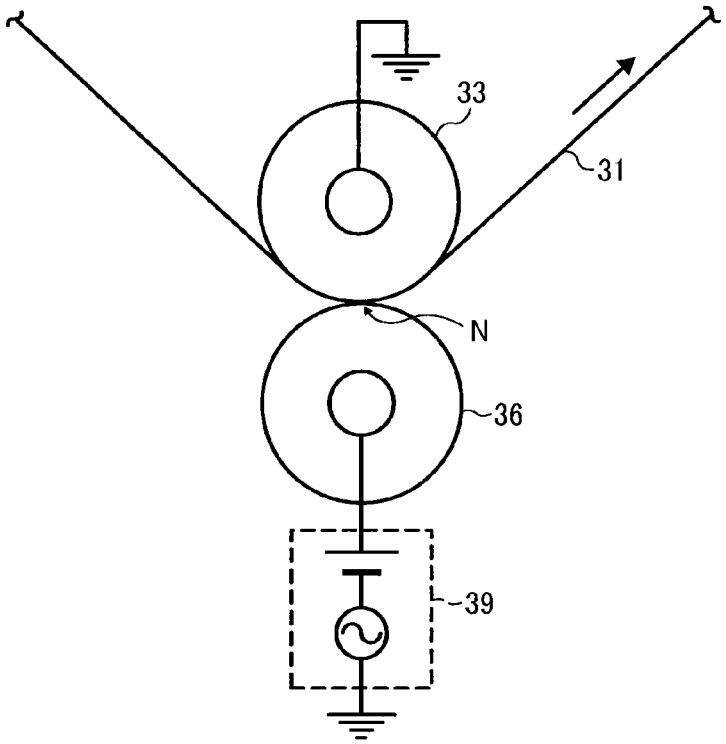
FIG. 3 is a schematic diagram illustrating a power source for secondary transfer employed in the image forming apparatus of FIG. 1.

Application of the secondary transfer bias is not limited to the embodiment shown in FIG. 1. Alternatively, as illustrated in FIG. 3, the opposed roller 33 is grounded while the superimposed bias from the power source 39 is applied to the nip forming roller 36. In this case, the polarity of the DC voltage is changed. More specifically, as illustrated in FIG. 1, when the superimposed bias is applied to the opposed roller 33 while the polarity of toner is negative and the nip forming roller 36 is grounded, the DC voltage of the same negative polarity as the toner is used so that a time-averaged potential of the superimposed bias is of the same negative polarity as the toner.

By contrast, as illustrated in FIG. 3, in a case in which the opposed roller 33 is grounded and the superimposed bias is applied to the nip forming roller 36, the DC voltage of positive polarity opposite that of the toner is used so that the polarity of the time-averaged potential of the superimposed bias is positive which is opposite that of the toner.

Figure 4:
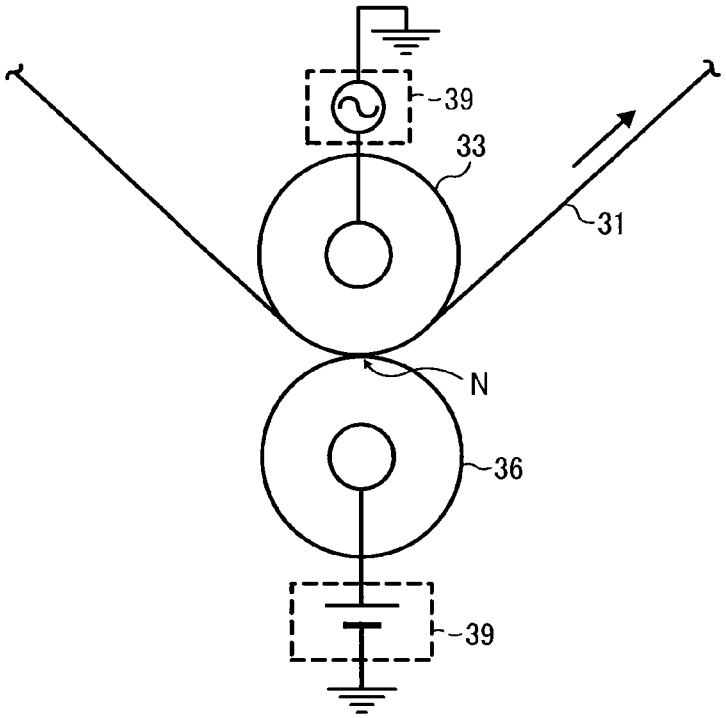
FIG. 4 is a schematic diagram illustrating a variation of the power source for the secondary transfer.
Figure 5:
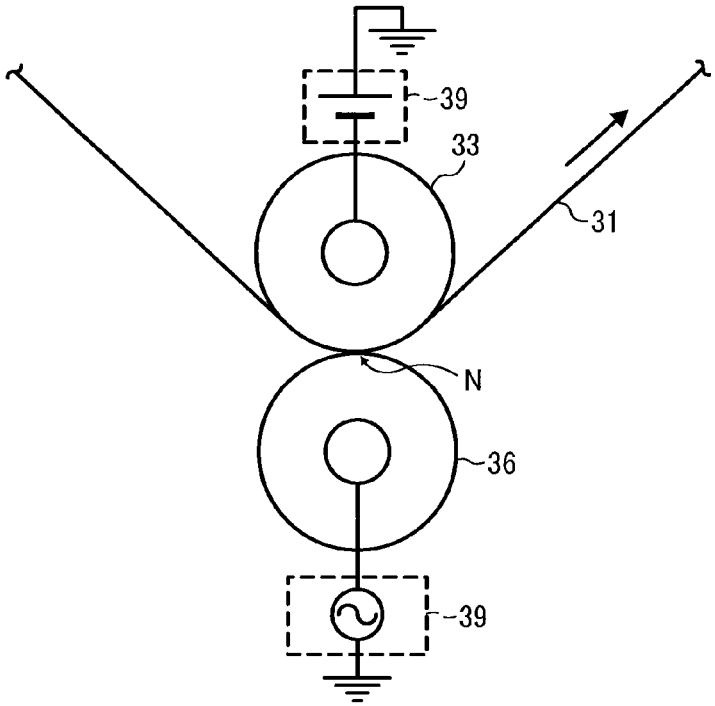
FIG. 5 is a schematic diagram illustrating another variation of the power source for the secondary transfer.

Alternatively, as illustrated in FIGS. 4 and 5, the DC voltage is supplied from the power source 39 to one of the opposed roller 33 and the nip forming roller 36 while supplying the AC voltage to the other roller, instead of supplying the superimposed bias to one of the opposed roller 33 and the nip forming roller 36.

Figure 6:
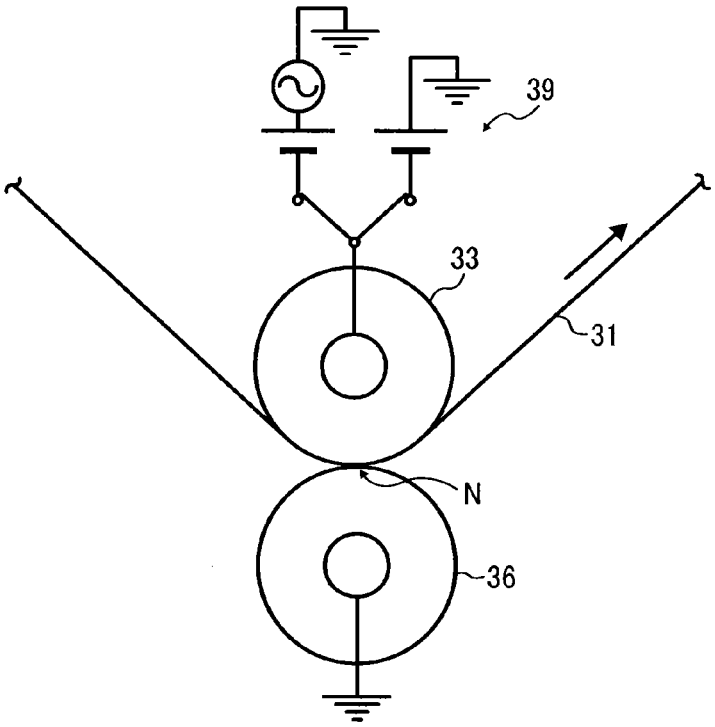
FIG. 6 is a schematic diagram illustrating another variation of the power source for the secondary transfer.
Figure 7:
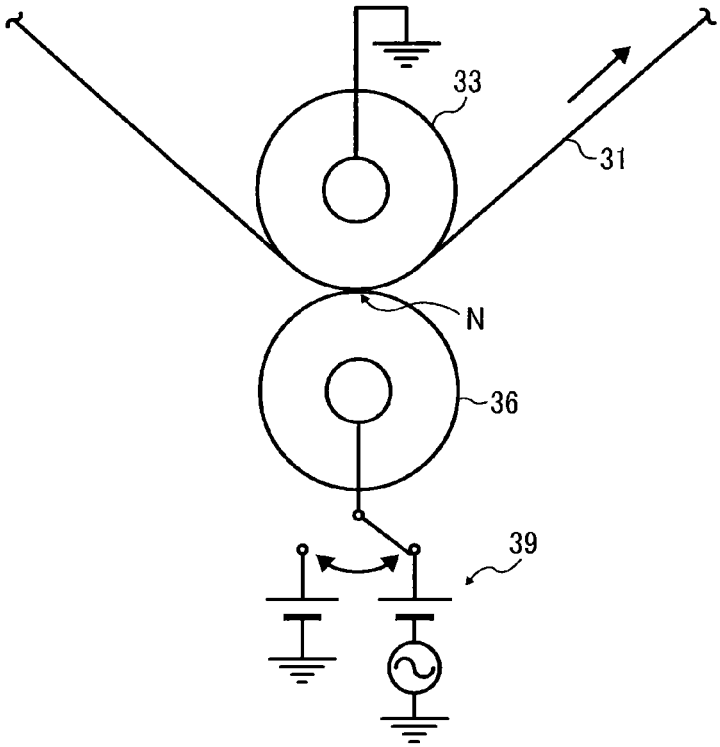
FIG. 7 is a schematic diagram illustrating another variation of the power source for the secondary transfer.

Application of the secondary transfer bias is not limited to the configurations described above. Alternatively, as illustrated in FIGS. 6 and 7, the power source 39 can switch between a combination of the DC voltage and the AC voltage, and the DC voltage, and supply the voltage to one of the opposed roller 33 and the nip forming roller 36. More specifically, as illustrated in FIG. 6, the power source 39 switches the voltage between the combination of the DC voltage and the AC voltage, and the DC voltage, and supplies the voltage to the opposed roller 33. Alternatively, as illustrated in FIG. 7, the power source 39 switches the voltage between the combination of the DC voltage and the AC voltage, and the DC voltage, and supplies the voltage to the nip forming roller 36.

Figure 8:
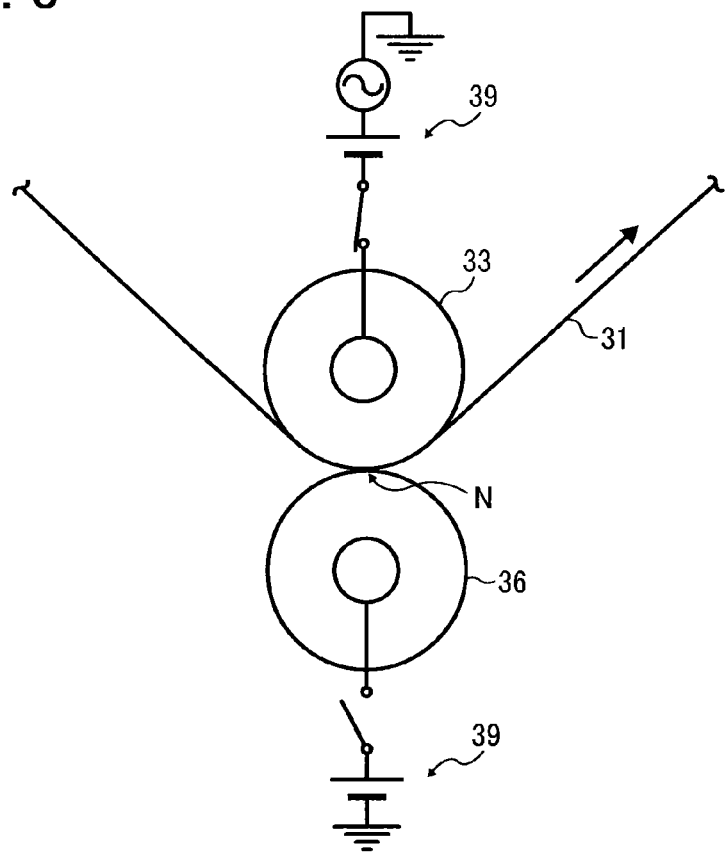
FIG. 8 is a schematic diagram illustrating another variation of the power source for the secondary transfer.
Figure 9:
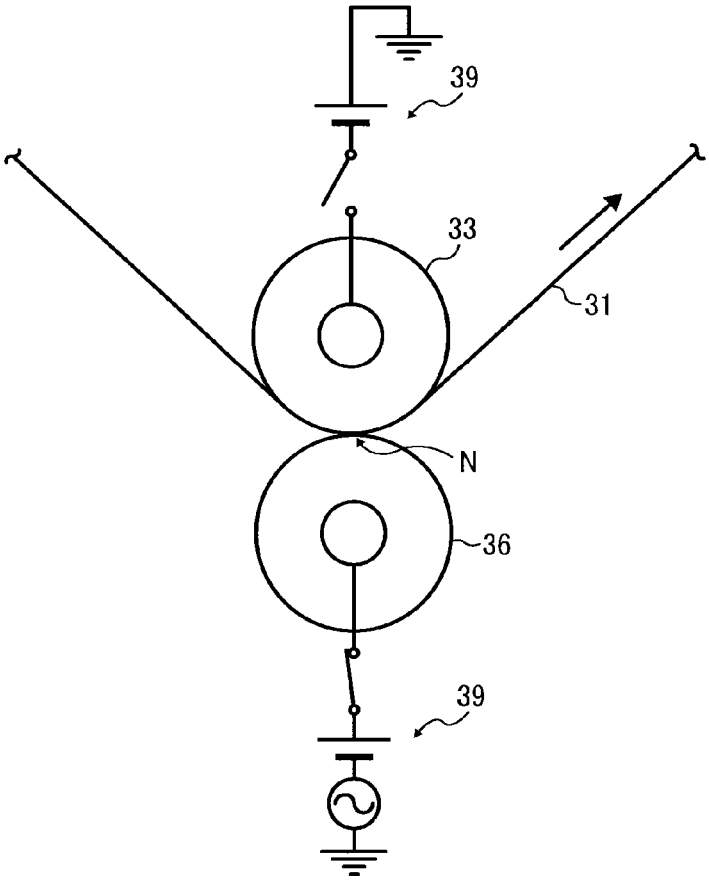
FIG. 9 is a schematic diagram illustrating another variation of the power source for the secondary transfer.

Alternatively, in a case in which the voltage is switched between the combination of the DC voltage and the AC voltage, and the DC voltage, as illustrated in FIGS. 8 and 9, the combination of the DC voltage and the AC voltage is supplied to one of the opposed roller 33 and the nip forming roller 36 while supplying the DC voltage to the other roller. More specifically, as illustrated in FIG. 8, the combination of the DC voltage and the AC voltage can be supplied to the opposed roller 33, and the DC voltage can be supplied to the nip forming roller 36. As illustrated in FIG. 9, the DC voltage can be supplied to the opposed roller 33, and the combination of the DC voltage and the AC voltage can be supplied to the nip forming roller 36.

As described above, there is a variety of ways in which the secondary transfer bias is applied to the secondary transfer nip N. Thus, a suitable power source may be selected. For example, a power source, such as the power source 39 capable of supplying the combination of the DC voltage and the AC voltage, may be employed. Alternatively, a power source capable of supplying independently the DC voltage and the AC voltage may be employed. Still alternatively, a single power source capable of switching application of the bias between the combination of the DC voltage and the AC voltage, and the DC voltage may be employed.

The power source 39 for the secondary transfer bias includes a first mode in which the power source 39 outputs only the DC voltage and a second mode in which the power source 39 outputs a superimposed voltage including the AC voltage superimposed on the DC voltage. The first mode and the second mode are switchable. According to the illustrative embodiments shown in FIG. 1 and FIGS. 3 through 5, the first mode and the second mode can be switched by turning on and off the output of the AC voltage. According to the illustrative embodiments shown in FIGS. 6 through 9, a plurality of power sources (here, two power sources) is employed and is switched selectively by a switching device such as a relay. By switching selectively between two power sources, the first mode and the second mode may be selectively switched.

When using a normal sheet of paper, such as the one having a relatively smooth surface, a pattern of dark and light according to the surface conditions of the sheet is less likely to appear on the recording medium. In this case, the first mode is selected and the secondary transfer bias consisting only of the DC voltage is supplied. By contrast, when using a recording medium such as pulp paper having a rough surface, the second mode is selected to supply a superimposed bias in which the AC voltage is superimposed on the DC voltage, as a secondary transfer bias. In other words, in accordance with a type (e.g., a degree of surface roughness) of the recording medium, the secondary transfer bias is switched selectively between the first mode and the second mode.

After the intermediate transfer belt 31 passes through the secondary transfer nip N, residual toner not having been transferred onto the recording medium P remains on the intermediate transfer belt 31. The residual toner is removed from the intermediate transfer belt 31 by the belt cleaning device 37 which contacts the surface of the intermediate transfer belt 31. The cleaning backup roller 34 disposed inside the loop formed by the intermediate transfer belt 31 supports the cleaning operation performed by the belt cleaning device 37 from inside the loop of the intermediate transfer belt 31 so that the residual toner remaining on the intermediate transfer belt 31 is removed reliably.

The fixing device 90 is disposed on the right side in FIG. 1, that is, downstream from the secondary transfer nip N in the direction of conveyance of the recording medium P. The fixing device 90 includes a fixing roller 91 and a pressing roller 92. The fixing roller 91 includes a heat source such as a halogen lamp inside thereof. While rotating, the pressing roller 92 pressingly contacts the fixing roller 91, thereby forming a heated area called a fixing nip therebetween. The recording medium P bearing an unfixed toner image on the surface thereof is delivered to the fixing device 90 and interposed by the fixing nip between the fixing roller 91 and the pressing roller 92. The surface of the recording medium P bearing the unfixed toner image tightly contacts the fixing roller 91. Under heat and pressure, toner adhered to the toner image is softened and fixed to the recording medium P in the fixing nip. Subsequently, the recording medium P is discharged outside the image forming apparatus from the fixing device 90 via the sheet passage after fixing.

According to the present illustrative embodiment, the controller 60 can carry out different printing modes, i.e., a normal mode, a high-quality mode, and a high-speed mode. In the normal mode, a process linear velocity, that is, a linear velocity of the photosensitive drum and the intermediate transfer belt, is approximately 280 mm/s. It is to be noted that the process linear velocity in the high quality mode in which priority is given to image quality over the printing speed is slower than that in the normal mode. On the contrary, the process linear velocity in the high-speed mode in which priority is given to the printing speed over the image quality is faster than that in the normal mode. Users can change the print modes between the normal mode, the high-quality mode, and the high-speed mode through a control panel 50 (illustrated in FIG. 16) of the image forming apparatus or a printer property menu in a personal computer.

In a case in which a monochrome image is formed, a movable support plate supporting the primary transfer rollers 35Y, 35M, and 35C of the transfer unit 30 is moved to separate the primary transfer rollers 35Y, 35M, and 35C from the photosensitive drums 2Y, 2M, and 2C. Accordingly, the front surface of the intermediate transfer belt 31, that is, the image bearing surface, is separated from the photosensitive drums 2Y, 2M, and 2C so that the intermediate transfer belt 31 contacts only the photosensitive drum 2K. In this state, only the image forming unit 1K is activated to form a black toner image on the photosensitive drum 2K.

According to the present illustrative embodiment, a DC component of the secondary transfer bias corresponds to a time-averaged value (Vave) of the voltage. That is, the DC component of the secondary transfer bias has the same value as the time-averaged voltage (time-averaged value) Vave of the DC component. The time-averaged value Vave of the voltage is a value of an integral value of a voltage waveform over one cycle divided by the length of one cycle.

In the image forming apparatus of the illustrative embodiment in which the secondary transfer bias is applied to the opposed roller 33 and the nip forming roller 36 is grounded, if the polarity of the superimposed bias is negative so is the polarity of the toner, the toner having the negative polarity is moved electrostatically from the opposed roller 33 side to the nip forming roller 36 side in the secondary transfer nip N. Accordingly, the toner on the intermediate transfer belt 31 is transferred onto the recording medium P.

By contrast, if the polarity of the superimposed bias is opposite that of the toner, that is, the polarity of the superimposed bias is positive, the toner having the negative polarity is attracted electrostatically to the opposed roller 33 side from the nip forming roller 36 side. Consequently, the toner transferred to the recording medium P is attracted again to the intermediate transfer belt 31 side.

When using a recording medium having a rough surface such as Japanese paper called Washi, a pattern of light and dark according to the surface conditions of the paper appears easily in an image. As described above, in order to prevent such an image defect, not only a DC voltage, but also a DC voltage superimposed on an AC voltage is applied as a secondary transfer bias.

Figure 10:
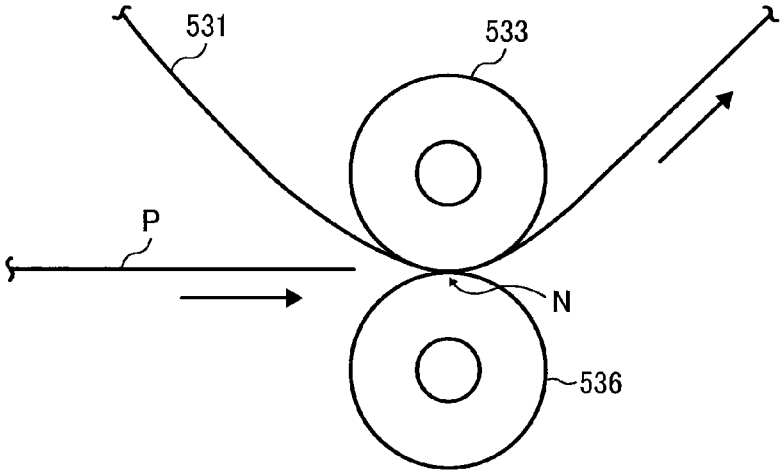
FIG. 10 is an enlarged diagram schematically illustrating an example of a secondary transfer nip.

Although advantageous and generally effective for its intended purpose, the toner is still not transferred well to the recessed portions of the surface of the recording medium P, resulting in image defects such as multiple white spots or dropouts. FIG. 10 is a schematic diagram illustrating a comparative example of the secondary transfer nip N at which an intermediate transfer belt 531 is pressed against a nip forming roller 536 by an opposed roller 533, thereby forming the secondary transfer nip N where the front surface of the intermediate transfer belt 531 and the nip forming roller 536 contact. In the secondary transfer nip N, a toner image on the intermediate transfer belt 531 is transferred secondarily onto a recording medium P fed to the secondary transfer nip N.

The secondary bias for transferring secondarily the toner image onto the recording medium P is applied to one of the nip forming roller 536 and the opposed roller 533, and the other one of these rollers is grounded. The toner image can be transferred onto the recording medium P by applying the transfer bias to either the nip forming roller 536 or the opposed roller 533. Herein, a description is provided of application of the secondary transfer bias to the opposed roller 533 when using toner having a negative polarity. In this case, in order to move the toner in the secondary transfer nip N from the opposed roller 533 side to the nip forming roller 536 side, a superimposed bias is applied as the secondary transfer bias. More specifically, the polarity of a time-averaged electrical potential of the secondary transfer bias is negative which is the same as that of the toner.

Figure 11:
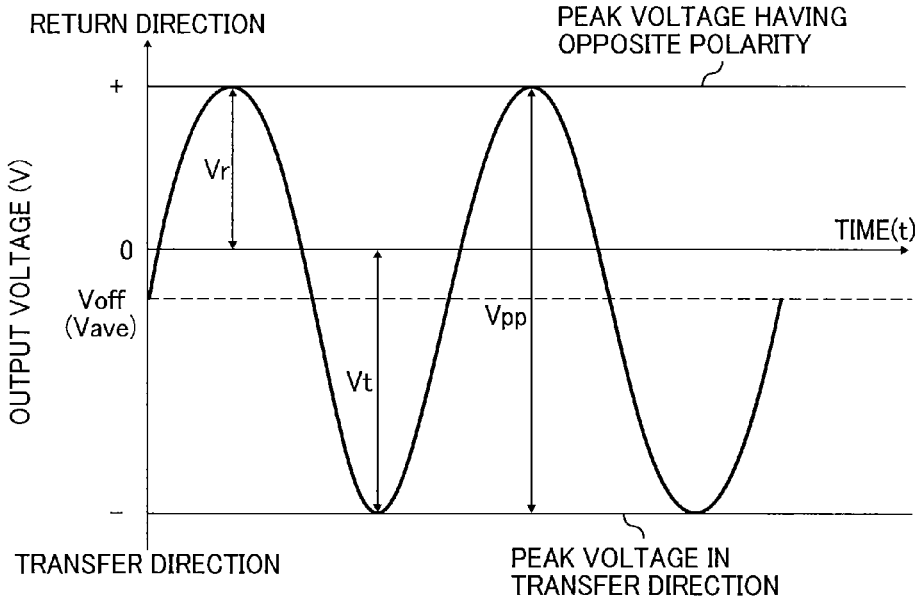
FIG. 11 is a waveform chart showing an example of a waveform of a voltage consisting of a superimposed bias.

With reference to FIG. 11, a description is provided of the secondary transfer bias using the superimposed bias applied to the opposed roller 533. FIG. 11 is a waveform chart showing an example of a waveform of the superimposed bias as the secondary transfer bias. In FIG. 11, the time-averaged voltage (it may be referred to as time-averaged value) Vave (V) represents a time-averaged value of the secondary transfer bias. In the example shown in FIG. 11, the superimposed bias as the secondary transfer bias has a sinusoidal waveform which has a peak (peak value of the voltage of the opposite polarity) in a return direction and a peak (peak value of voltage) in a transfer direction. In FIG. 11, a reference sign Vt refers to one of the two peak values, that is, the peak value in the transfer direction in which the toner is transferred from the belt side to the nip forming roller 536 side. Thereafter, this peak value is referred to as a transfer peak value Vt. A reference sign Vr refers to the other peak value, that is, the peak value in the return direction in which the toner returns from the nip forming roller 536 side to the belt side. Thereafter, this peak value is referred to as a return peak value Vr.

Even when an AC bias including only an AC component is applied instead of the superimposed bias, it is possible to move the toner back and forth between the intermediate transfer belt 531 and the recording medium P in the secondary transfer nip N. However, the AC bias causes the toner to simply move back and forth between the intermediate transfer belt 531 and the recording medium P, and it is difficult to transfer the toner onto the recording medium P. If the superimposed bias including the DC component is applied to adjust the time-averaged voltage Vave (V), that is, the time-averaged value of the superimposed bias, to the same negative polarity as the toner, it is possible to move the toner relatively from the belt side toward the recording medium P while the toner moves back and forth between the belt side and the recording medium side. Ultimately, the toner can be transferred relatively from the intermediate transfer belt to the recording medium P.

According to experiments performed by the present inventors, when application of the secondary transfer bias including a superimposed bias is initiated, only a very small number of toner particles on the surface of a toner layer on the intermediate transfer belt 531 first separates from the toner layer and moves toward recessed portions of the surface of the recording medium P. However, most of the toner particles in the toner layer remain therein. The very small number of toner particles separated from the toner layer enters the recessed portions of the surface of the recording medium P. Subsequently, if the direction of the electric field is reversed, the toner particles return from the recessed portions to the toner layer. When this happens, the toner particles returning to the toner layer strike the toner particles remaining in the toner layer so that adhesion of the toner particles to the toner layer (or to the recording medium P) is weakened.

As a result, when the direction of the electric field reverses towards the direction of the recording medium P, more toner particles than in the initial time separate from the toner layer and move to the recessed portions of the recording medium P. As this process is repeated, the amount of toner particles separating from the toner layer and entering the recessed portions of the recording medium P is increased gradually. Consequently, a sufficient amount of toner particles is transferred to the recessed portions of the recording medium P.

In this configuration, however, the level of the return peak value Vr shown in FIG. 11 needs to be relatively high. Otherwise, the toner particles once entered in the recessed portions of the recording medium surface cannot be returned adequately to the toner layer on the intermediate transfer belt, resulting in a deficiency in the image density at the recessed portions. Furthermore, the level of the time-averaged value Vave (V) of the secondary transfer bias needs to be relatively high. Otherwise, an amount of toner transferred onto projecting portions of the recording medium P is insufficient, resulting also in a deficiency in image density at the projecting portions.

In order to obtain sufficient image density at both the projecting and the recessed portions of the recording medium surface, the time-averaged value Vave (V) and the return peak value Vr need to be relatively large. To obtain a relatively large time-averaged value Vr and a return peak value Vt, a peak-to-peak voltage Vpp needs to be set relatively high. Here, the peak-to-peak voltage Vpp refers to a vertical length of the waveform of the superimposed bias from the crest (highest value) of the return peak value Vr to the very bottom (lowest value) of the transfer peak value Vt. Consequently, the transfer peak value Vt is also relatively high. The transfer peak value Vt corresponds to the maximum potential difference between the nip forming roller 536 being grounded and the opposed roller 533. Hence, when the transfer peak value Vt becomes high, an electric discharge tends to occur easily between the rollers. More specifically, an electric discharge occurs between a slight gap between the belt surface and the recessed portions of the recording medium surface, causing dropouts or white spots in the image formed on the recessed portions of the recording medium surface.

The present inventors have recognized that image defects such as dropouts and white spots tend to occur easily in the image formed on the recessed portions of the recording medium surface because the peak-to-peak voltage Vpp is relatively high to obtain sufficient image density both in the projecting portions and the recessed portions of the recording medium surface.

Figure 12:
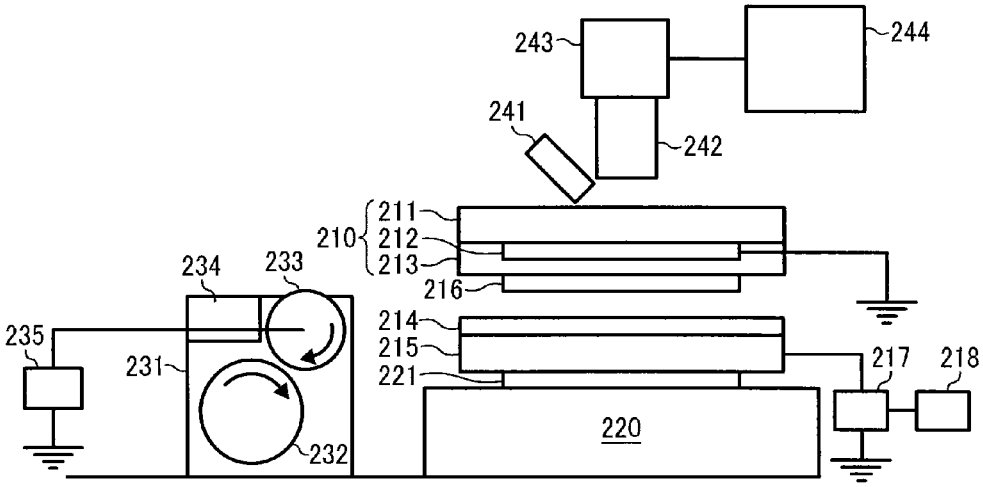
FIG. 12 is a schematic diagram illustrating an observation equipment for observation of behavior of toner in the secondary transfer nip.

Next, a description is provided of transfer experiments performed by the present inventors. The present inventors performed observation experiments using special observation equipment shown in FIG. 12. FIG. 12 is a schematic diagram illustrating the observation equipment for observation of behavior of toner in the secondary transfer nip N. The observation equipment includes a transparent substrate 210, a metal plate 215, a substrate 221, a development device 231, a power supply 235, a Z stage 220, a light source 241, a microscope 242, a high-speed camera 243, a personal computer 244, a voltage amplifier 217, a waveform generator 218, and so forth. The transparent substrate 210 includes a glass plate 211, a transparent electrode 212 made of Indium Tin Oxide (ITO) and disposed on a lower surface of the glass plate 211, and a transparent insulating layer 213 made of a transparent material covering the transparent electrode 212. The transparent substrate 210 is supported at a predetermined height position by a substrate support. The substrate support is allowed to move in the vertical and horizontal directions in the drawing by a moving assembly.

In the illustrated example shown in FIG. 12, the transparent substrate 210 is located above the metal plate 215 placed on the Z stage 220. In accordance with the movement of the substrate support, the transparent substrate 210 can be moved to a position directly above the development device 231 disposed lateral to the Z stage 220. The transparent electrode 212 of the transparent substrate 210 is connected to a grounded electrode fixed to the substrate support.

The developing device 231 is similar in configuration to the developing device 8K illustrated in FIG. 2 according to the illustrative embodiment, and includes a screw 232, a development roller 233, a doctor blade 234, and so forth. The development roller 233 is driven to rotate with a development bias applied thereto by the power supply 235.

In accordance with the movement of the substrate support, the transparent substrate 210 is moved at a predetermined speed to a position directly above the developing device 231 and disposed opposite the development roll 233 with a predetermined gap therebetween. Then, toner on the developing roller 233 is transferred to the transparent electrode 212 of the transparent substrate 210. Thereby, a toner layer 216 having a predetermined thickness is formed on the transparent electrode 212 of the transparent substrate 210. The toner adhesion amount per unit area in the toner layer 216 is adjustable by the toner density in the developing agent, the toner charge amount, the developing bias value, the gap between the transparent substrate 210 and the developing roller 233, the moving speed of the transparent substrate 210, the rotation speed of the developing roller 233, and so forth.

The transparent substrate 216 formed with the toner layer 210 is translated to a position opposite a recording medium 214 adhered to the planar metal plate 215 by a conductive adhesive. The metal plate 215 is placed on the substrate 221 which is provided with a load sensor and placed on the Z stage 220. Further, the metal plate 215 is connected to the voltage amplifier 217. The waveform generator 218 provides the voltage amplifier 217 with a transfer bias including a DC voltage and an AC voltage. The transfer bias is amplified by the voltage amplifier 217 and applied to the metal plate 215.

If the Z stage 220 is driven to elevate the metal plate 215, the recording medium 214 starts coming into contact with the toner layer 216. If the metal plate 215 is further elevated, the pressure applied to the toner layer 216 increases. The elevation of the metal plate 215 is stopped when the output from the load sensor reaches a predetermined value. With the pressure maintained at the predetermined value, a transfer bias is applied to the metal plate 215, and the behavior of the toner is observed. After the observation, the Z stage 220 is driven to lower the metal plate 215 and separate the recording medium 214 from the transparent substrate 210. Thereby, the toner layer 216 is transferred onto the recording medium 214.

The behavior of the toner is examined using the microscope 242 and the high-speed camera 243 disposed above the transparent substrate 210. The transparent substrate 210 is formed of the layers of the glass plate 211, the transparent electrode 212, and the transparent insulating layer 213, which are all made of transparent material. It is therefore possible to observe, from above and through the transparent substrate 210, the behavior of the toner located under the transparent substrate 210.

In the present experiment, a microscope using a zoom lens VH-Z75 manufactured by Keyence Corporation was used as the microscope 242. Further, a camera FASTCAM-MAX 120KC manufactured by Photron Limited was used as the high-speed camera 243 controlled by the personal computer 244. The microscope 242 and the high-speed camera 243 are supported by a camera support. The camera support adjusts the focus of the microscope 242.

The behavior of the toner on the transparent substrate 210 was photographed as follows. That is, the position at which the behavior of the toner is observed was illuminated with light by the light source 241, and the focus of the microscope 242 was adjusted. Then, a transfer bias was applied to the metal plate 215 to move the toner in the toner layer 210 adhering to the lower surface of the transparent substrate 216 toward the recording medium 214. The behavior of the toner in this process was photographed by the high-speed camera 243.

The structure of the transfer nip in which toner is transferred onto a recording medium is different between the observation experiment equipment illustrated in FIG. 12 and the image forming apparatus of the illustrative embodiment. Therefore, the transfer electric field acting on the toner is different therebetween, even if the applied transfer bias is the same. To find appropriate observation conditions, transfer bias conditions allowing the observation experiment equipment to attain favorable density reproducibility on recessed portions of a surface of a recording medium were investigated.

A sheet of FC Japanese paper SAZANAMI manufactured by NBS Ricoh Company, Ltd. was used as the recording medium 214. The yellow toner having an average toner particle diameter of approximately 6.8 μm mixed with a relatively small amount of black (K) toner was used as the toner. The observation experiment equipment is configured to apply the transfer bias to a rear surface of the recording medium 214 (i.e., SAZANAMI). Therefore, in the observation experiment equipment, the polarity of the transfer bias capable of transferring the toner onto the recording medium 214 is opposite the polarity of the transfer bias employed in the image forming apparatus according to the illustrative embodiment (i.e., positive polarity).

As the AC component of the secondary transfer bias including a superimposed bias, an AC component having a sinusoidal waveform was employed. The frequency F of the AC component was set to approximately 1000 Hz. Further, the DC component (that is, the time-averaged value Vave in the illustrative embodiment) was set to approximately 200 V, and a peak-to-peak voltage Vpp was set to approximately 1000 V. The toner layer 216 was transferred onto the recording medium 214 with a toner adhesion amount in a range of from approximately 0.4 mg/cm$^2$ to approximately 0.5 mg/cm$^2$. As a result, a sufficient image density was successfully obtained on the recessed portions of the surface of the SAZANAMI paper sheet.

Under the above-described conditions, the behavior of the toner was photographed with the microscope 242 focused on the toner layer 216 on the transparent substrate 210, and the following phenomenon was observed. That is, the toner particles in the toner layer 216 moved back and forth between the transparent substrate 210 and the recording medium 214 due to an alternating electric field generated by the AC component of the transfer bias. With an increase in the number of the back-and-forth movements, the amount of toner particles moving back and forth was increased.

Figure 13:
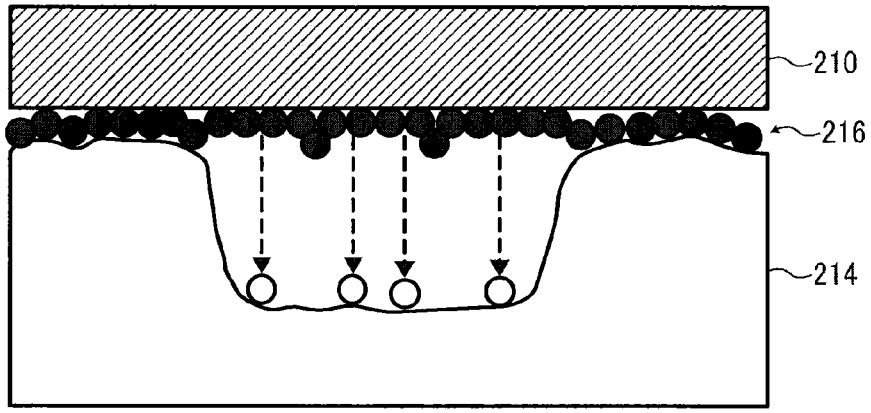
FIG. 13 is an enlarged schematic diagram illustrating behavior of toner in the secondary transfer nip at the beginning of transfer.
Figure 14:
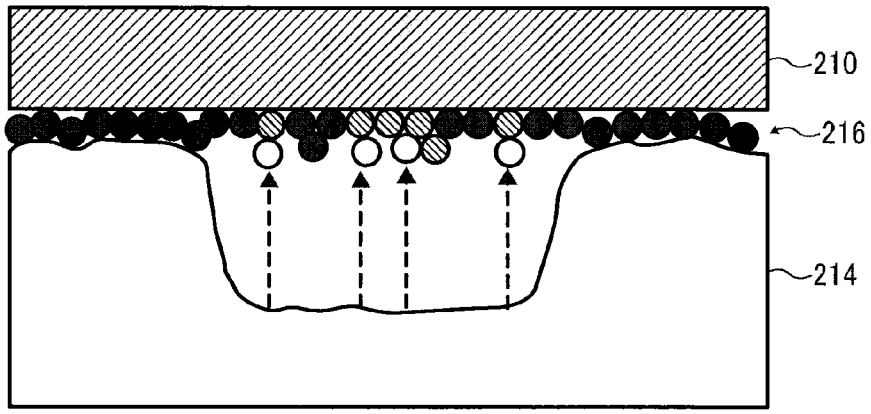
FIG. 14 is an enlarged schematic diagram illustrating behavior of the toner in the secondary transfer nip in the middle phase of transfer.

More specifically, in the transfer nip, there was one back-and-forth movement of toner particles in every cycle 1/f of the AC component of the secondary transfer bias due to a single action of the alternating electric field. In the first cycle, only toner particles present on the surface of the toner layer 216 separated from the toner layer 216, as illustrated in FIG. 13. The toner particles then entered the recessed portions of the recording medium 214, and subsequently returned again to the toner layer 216, as illustrated in FIG. 14. In this process, the returning toner particles collided with other toner particles remaining in the toner layer 216, thereby reducing the adhesion of the other toner particles to the toner layer 216 or to the transparent substrate 210. In the next cycle, therefore, a larger amount of toner particles than in the previous cycle separated from the toner layer 216, as illustrated in FIG. 14.

Figure 15:
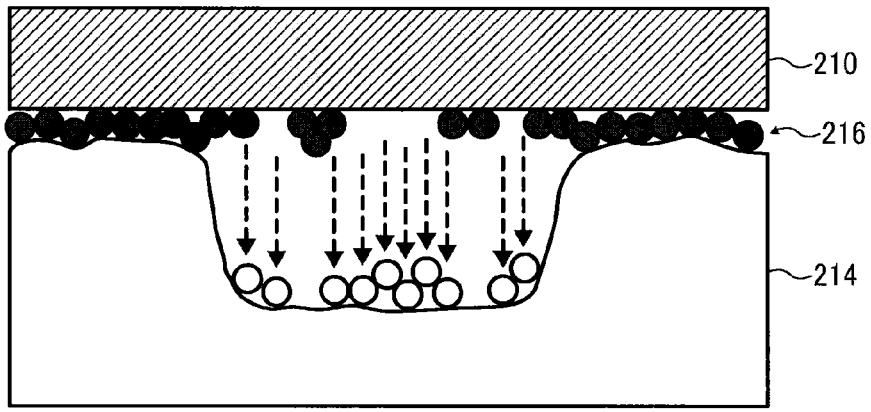
FIG. 15 is an enlarged schematic diagram illustrating behavior of toner in the secondary transfer nip in the last phase of transfer.

Subsequently, the toner particles entered the recessed portions of the recording medium 214, and then returned again to the toner layer 216. In this process, the returning toner particles collided with other toner particles remaining in the toner layer 216, thereby reducing the adhesion of the other toner particles to the toner layer 216 or to the transparent substrate 210. In the next cycle, therefore, a larger amount of toner particles than in the last cycle separated from the toner layer 216, as illustrated in FIG. 15.

As described above, the number of toner particles moving back and forth was gradually increased in every back-and-forth movement. After the lapse of a nip passage time, that is, the time required for the toner to pass through the secondary transfer nip with the belt (in the transfer experiment equipment, after the time corresponding to the actual nip passage time elapses), a sufficient amount of toner had been transferred to the recessed portions of the recording medium 214.

Furthermore, the behavior of the toner was photographed under conditions with a DC voltage (i.e., the time-averaged value Vave according to the illustrative embodiment) of approximately 200 V and the peak-to-peak voltage Vpp of approximately 800 V, and the following phenomenon was observed. It is to be noted that the peak-to-peak voltage Vpp is measured from a peak at the positive side to a peak at the negative side of the bias in one cycle, that is, the peak in the return direction and the peak in the transfer direction according to the illustrative embodiment. Some of the toner particles in the toner layer 216 present on the surface thereof separated from the toner layer 216 in the first cycle, and entered the recessed portions of the recording medium 214.

Subsequently, however, the toner particles entered the recessed portions remained therein, without returning to the toner layer 216. In the next cycle, a very small number of toner particles newly separated from the toner layer 216 and entered the recessed portions of the recording medium 214. After the lapse of the nip passage time, therefore, only a relatively small amount of toner particles had been transferred to the recessed portions of the recording medium 214.

The present inventors conducted further experiments and found the following. That is, the return peak value Vr capable of causing the toner particles separated from the toner layer 216 and entered the recessed portions of the recording medium 214 to return to the toner layer 216 in the initial cycle depends on the toner adhesion amount per unit area on the transparent substrate 210. More specifically, the greater is the toner adhesion amount on the transparent substrate 210, the greater is the return peak value Vr capable of causing the toner particles in the recessed portions in the recording medium 214 to return to the toner layer 216.

Figure 16:
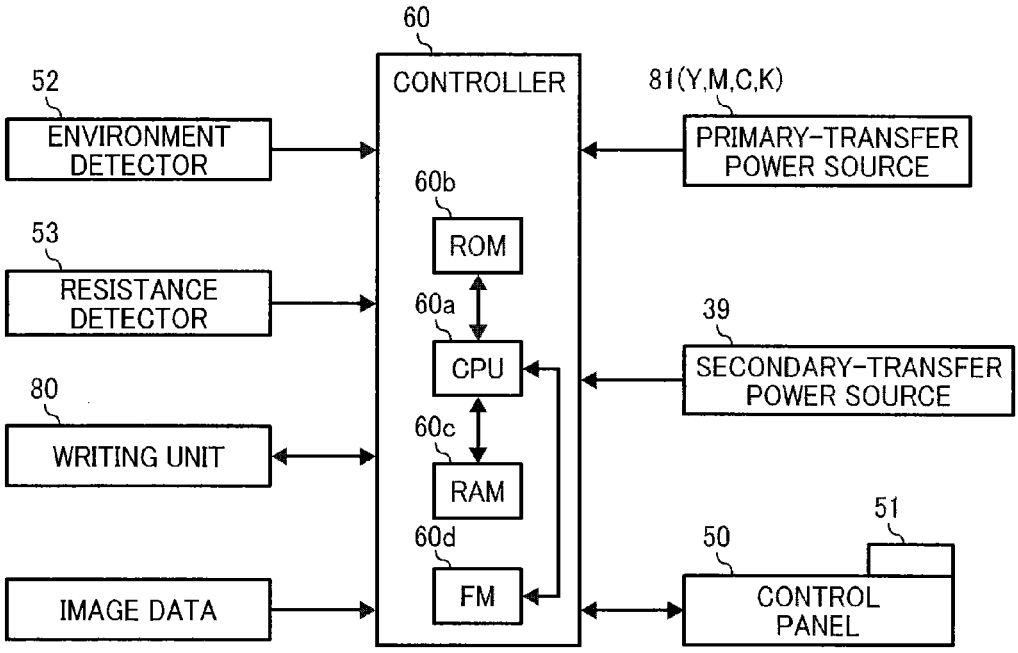
FIG. 16 is a block diagram illustrating an example of an electrical circuit of a control system of the image forming apparatus.

With reference to FIG. 16, a description is provided of a characteristic configuration of the image forming apparatus according to an illustrative embodiment of the present disclosure.

FIG. 16 is a block diagram illustrating a control system of the image forming apparatus of FIG. 1. As illustrated in FIG. 16, the controller 60 constituting a part of the transfer bias generator includes a Central Processing Unit (CPU) 60*a* serving as an operation device, a Random Access Memory (RAM) 60*c* serving as a nonvolatile memory, a Read-Only Memory (ROM) 60*b* serving as a temporary storage device, a flash memory (FM) 60*d*, and so forth. The controller 60 controlling the entire image forming apparatus is connected to a variety of devices and sensors. FIG. 16, however, illustrates only the devices associated with the characteristic configuration of the image forming apparatus of the illustrative embodiment.

The primary transfer bias power sources 81Y, 81M, 81C, and 81K supply a primary transfer bias to the primary transfer rollers 35Y, 35M, 35C, and 35K. The power source 39 outputs a secondary transfer bias to be supplied to the secondary transfer nip N. According to the present illustrative embodiment, the power source 39 outputs the secondary transfer bias to be applied to the opposed roller 33. The power source 39 constitutes the transfer bias generator together with the controller 60.

The control panel 50 includes a touch panel and a keypad. The control panel 50 displays an image on a screen of the touch panel, and receives an instruction entered by users using the touch panel and the keypad. The control panel 50 is capable of showing an image on the touch panel on the basis of a control signal transmitted from the controller 60.

The control panel 50 includes a selection device 51 for selecting a sheet type of the recording medium P. The selection device 51 selects arbitrarily the sheet type of the recording medium P to be used in the image forming apparatus and sends information of the recording medium P such as roughness of the surface of the recording medium P, as input information. Alternatively, the roughness of the recording medium P may be provided to the controller 60 without using the selection device 51 by detecting the sheet type based on electrical resistance and reflectivity of known recording media, for example. Accordingly, the sheet type may be input as the surface roughness information to the controller 60.

An environment detector 52 for detecting temperature and humidity in the image forming apparatus, and a resistance detector 53 for detecting electrical resistance of a transfer section are connected to the controller 60 via signal lines. As illustrated in FIG. 1, the resistance detector 53 is disposed between the power source 39 and the opposed roller 33. The electrical resistance at the transfer section herein refers to electrical resistance on an electrical path from the power source 39 and the nip forming roller 36. As illustrated in FIG. 1, the power source 39 is connected electrically to the metal cored bar of the opposed roller 33. The nip forming roller 36 is grounded. In this case, the opposed roller 33, the intermediate transfer belt 31, and the nip forming roller 36 constitute the transfer section.

The electrical resistance at the transfer section herein refers to electrical resistance on an electrical path from the metal cored bar of the opposed roller 33 connected to the power source 39 to the metal cored bar of the nip forming roller 36 connected electrically to the electrically grounded nip forming roller 36 via the secondary transfer nip N.

According to the present illustrative embodiment, the electrical resistance of the transfer section is detected such that the nip forming roller 36 and the intermediate transfer belt 31 are in contact with each other without the recording medium P, and a certain current, for example, −40 μA, is supplied at the same speed as during the printing operation. The voltage is then measured by the resistance detector 53. Accordingly, the electrical resistance of the transfer section is detected.

According to the present illustrative embodiment, the time-averaged voltage value (Vave) of the AC component of the secondary transfer bias needs to be closer to the transfer side than is a midpoint voltage value (Voff) intermediate between a maximum value of and a minimum value of the voltage in the AC component. In order to obtain such a configuration, an area in the return direction in the waveform needs to be smaller than an area in the transfer direction relative to the midpoint voltage value Voff of the AC component. The time-averaged value refers to a time-averaged value of the voltage which is a quotient of an integral value of a voltage waveform over one cycle divided by the length of one cycle.

Figure 17:
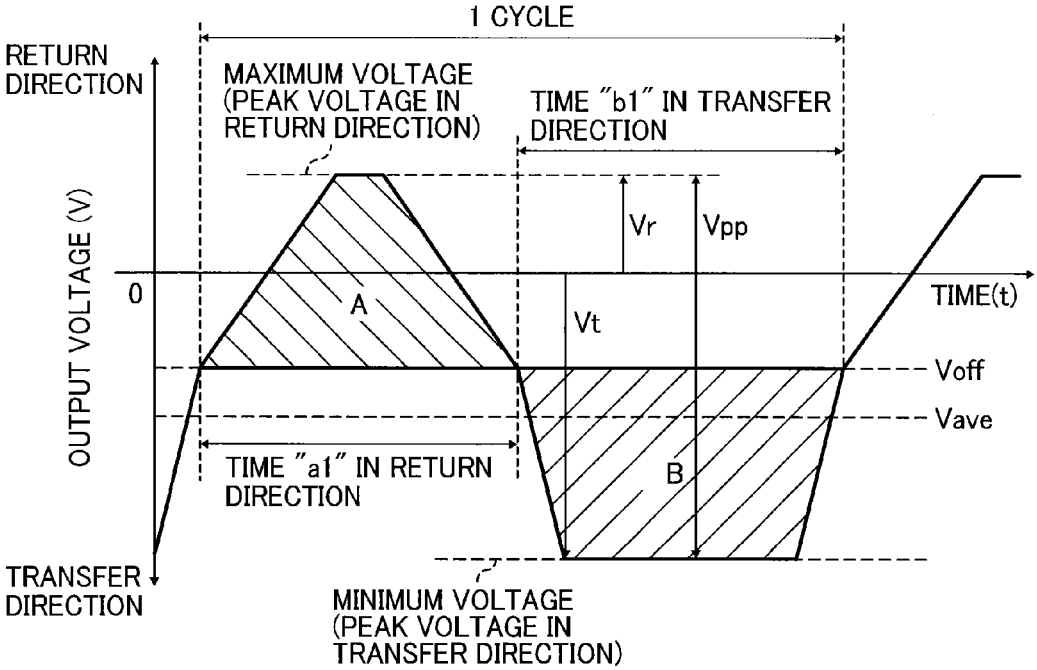
FIG. 17 is a waveform chart showing an example of a waveform of the secondary transfer bias provided by the power source controlled by a controller.

In view of the above, in one example, as illustrated in FIG. 17, the waveform may be a trapezoid waveform in which an inclination of rising and falling of the voltage in the return direction is less than that in the transfer direction. FIG. 17 shows a waveform of the secondary transfer bias. The waveform is not limited to the trapezoid waveform. Alternatively, the waveform may be a triangular waveform, a square waveform, and a combination of these waveforms, but may not be limited thereto.

As a value representing a relation of the midpoint voltage value Voff and the time-averaged value Vave, a ratio of an area in the return direction relative to the midpoint voltage value Voff to the entire AC waveform is set as a return time ratio (%). That is, the return time ratio % or a duty ratio (Duty) is expressed by the following equation: Duty=A/(A+B), where A represents an area of an alternating waveform in the return direction relative to the midpoint voltage value Voff in one cycle, B represents an area of the alternating waveform in the transfer direction relative to the midpoint voltage value Voff.

In other words, the return time ratio (%) or the duty ratio (Duty) is a ratio of time during which the voltage having polarity opposite that of the voltage in the transfer direction relative to the midpoint voltage value Voff is output in one cycle of the alternating waveform of the voltage.

With reference to FIGS. 18 through 24, a description is provided of Embodiments 1 through 6, according to the present disclosure. In each of Embodiments 1 through 6, the controller 60 controls the power source 39 to adjust an output voltage therefrom. The configurations of Embodiment 1 through 6 all have the same configurations as all the others differing only in reference parameters for control. FIG. 18 is a table showing names and the basis weight (grams per square meter) of recording media used in Embodiment 1 through 6. A depth of a recessed portion of a recording medium represents the degree of roughness of the recording medium. The greater is the depth of the recessed portion, the greater is the degree of roughness.

In each of Embodiments 1 through 6, transferability and an electric discharge at the recessed portion are graded on a five point scale of 1 to 5, and the description of the grades is provided as follows.

[Transferability]

In FIGS. 19 through 24, when toner is transferred adequately to the recessed portion of the recording medium and hence adequate image density is obtained at the recessed portion, it is graded as "5". When an area having white spots (i.e., lack of toner) in the recessed portion of the recording medium is small or the image density at the recessed portion is slightly lower than a smooth portion of the recording medium, it is graded as "4". When the area having white spots is relatively large or the image density is significantly low, it is graded as "3". When the area having white spots is greater than the area of grade 3 or the image density is lower than the image density of grade 3, it is graded as "2". When the entire recessed portion appears as white and hence the recessed portion is easily recognized or even worse, it is graded as "1".

[Electric Discharge]

In the secondary transfer nip N, an electric discharge is generated in a slight gap between the recessed portion of the recording medium P and the intermediate transfer belt 31 depending on the secondary transfer bias, thereby generating white spots in an image.

In FIGS. 19 through 24, appearance of white spots due to the electric discharge is graded as follows. When there is no white spots due to the electric discharge, it is graded as "5". Although some white spots are recognized but the number of white spots is small, and the size of the white spots is relatively small, it is graded as "4". When there are more white spots than grade 4, it is graded as "3". When there are even more white spots than grade "3", it is graded as "2". When the white spots are recognized all over the image which is worse than grade "2", it is graded as "1".

Embodiment 1

With reference to FIG. 19, a description is provided of Embodiment 1. According to the present illustrative embodiment, the image forming apparatus of FIG. 1 is employed. In this embodiment, the controller 60 controls the power source 39 to reduce the duty ratio (Duty) expressed by "A/(A+B)" as the roughness of the recording medium increases. Here, A refers to the area of the alternating waveform of the voltage in the return direction relative to the midpoint voltage value Voff in one cycle, and B refers to the area in the transfer direction relative to the midpoint voltage value Voff. The results are shown in FIG. 19. According to the present illustrative embodiment, information on the roughness of the recording medium P to be used includes the roughness of the recording medium P selected by the selection device 51.

In a comparative example shown in FIG. 19, different recording media are used, but the peak-to-peak voltage Vpp and the duty ratio (Duty) are not changed. In this case, the greater is the depth of the recessed portion of the recording medium P, the lower is the grade of the transferability. The shallower is the depth of the recessed portion of the recording medium P, the lower is the grade of electric discharge.

By contrast, according to the present illustrative embodiment, different recording media are used and the peak-to-peak voltage Vpp is not changed regardless of the depth of the recording medium P, while changing only the duty ratio (Duty). As a result, the time-averaged voltage Vave changes.

That is, when the depth of the recessed portion is relatively large and the duty ratio (Duty) is reduced, an absolute value of the time-averaged value of the voltage increases, hence enhancing the transferability at the recessed portion. In other words, the transferability increases so that adequate image density is obtained both at the recessed portion and the projecting portion of the recording medium, while suppressing generation of the white spots and hence obtaining a desired image quality.

Embodiment 2

With reference to FIG. 20, a description is provided of Embodiment 2. According to the present illustrative embodiment, the image forming apparatus of FIG. 1 is employed. In this embodiment, the controller 60 controls the power source 39 to reduce the duty ratio (Duty) expressed by "A/(A+B)" as the temperature and/or humidity detected by the environment detector 52 decreases. Here, A refers to the area of the alternating waveform of the voltage in the return direction relative to the midpoint voltage value Voff in one cycle, and B refers to the area in the transfer direction relative to the midpoint voltage value Voff. The results are shown in FIG. 20.

In a comparative example shown in FIG. 20, the same recording medium is used and the peak-to-peak voltage Vpp and the duty ratio (Duty) remain unchanged while changing the temperature and the humidity. In the present comparative example, as the temperature and the humidity decrease, the transferability at the recessed portion is graded lower but the electric discharge is graded higher.

By contrast, according to the illustrative embodiment, when the duty ratio (Duty) is decreased as the temperature and/or the humidity decreases, the absolute value of the time-averaged value Vave increases and the grade on the transferability at the recessed portion is enhanced while keeping the grade of the electric discharge high. Accordingly, the transferability increases so that adequate image density is obtained both at the recessed portion and the projecting portion of the recording medium P, suppressing generation of the white spots and hence obtaining a desired image quality.

Embodiment 3

With reference to FIG. 21, a description is provided of Embodiment 3. According to the present illustrative embodiment, the image forming apparatus of FIG. 1 is employed. In this embodiment, the controller 60 controls the power source 39 to reduce the duty ratio (Duty) expressed by "A/(A+B)" as the electrical resistance detected by the resistance detector 53 increases. Here, A refers to the area of the alternating waveform of the voltage in the return direction relative to the midpoint voltage value Voff in one cycle, and B refers to the area in the transfer direction relative to the midpoint voltage value Voff. The results are shown in FIG. 21.

In a comparative example shown in FIG. 21, the same recording medium is used and the peak-to-peak voltage Vpp and the duty ratio (Duty) remain unchanged, while changing only resistance of parts. In the present comparative example, the higher is the resistance, the lower is the grade of the transferability at the recessed portion of the recording medium. The lower is the resistance, the lower is the grade of the electric discharge.

By contrast, according to the illustrative embodiment, by reducing the duty ratio (Duty) as the electrical resistance increases, the absolute value of the time-averaged value Vave of the voltage increases and hence the grade on the transferability at the recessed portion is enhanced. Furthermore, by increasing the duty ratio (Duty) as the resistance decreases, the grade on the electric discharge is enhanced while maintaining the grade of the transferability of the recessed portion unchanged.

Accordingly, by reducing the duty ratio (Duty) as the electrical resistance detected by the resistance detector 53 increases, the time-averaged value Vave increases even when the peak-to-peak voltage Vpp is the same. With this configuration, the transferability increases so that adequate image density is obtained both at the recessed portion and the projecting portion of the recording medium, suppressing generation of the white spots and hence obtaining a desired image quality.

Embodiment 4

With reference to FIG. 22, a description is provided of Embodiment 4. In the present illustrative embodiment, the output voltage of the power source 39 is controlled with new additional parameters added to the parameters employed in Embodiment 1. According to the present illustrative embodiment, as the roughness of the recording medium P increases, that is, the roughness of the recording medium P selected by the selection device 51 increases, the power source 39 is controlled to reduce the duty ratio (Duty) expressed by A/(A+B). In the meantime, as the difference (Vpp) between the maximum voltage and the minimum voltage during transfer increases, the power source 39 is controlled to reduce the duty ratio (Duty). The results are shown in FIG. 22.

In a comparative example shown in FIG. 22, the same the duty ratio (Duty) is employed when the peak-to-peak voltage Vpp and the time-averaged value Vave are changed. By contrast, in Embodiment 4, the duty ratio (Duty) is changed for each type of the recording medium.

In the comparative example, depending on the recording medium P, the return peak value Vr and the transfer peak value Vt have the following relation: $|Vr|>|Vt|$ or $|Vr|<|Vt|$ When $|Vr|>|Vt|$, there is a risk of electric discharge at Vr. When $|Vr|<|Vt|$, there is a risk of electric discharge at Vt. In other words, the higher is the peak-to-peak voltage Vpp, the lower is the grade on the electric discharge.

By contrast, according to the present illustrative embodiment, the return peak value Vr and the transfer peak value Vt have the following relation: $|Vr|\approx|Vt|$ This means that the risk of electric discharge is reduced at both Vr and Vt. In other words, when the peak-to-peak voltage Vpp increases, increasing the duty ratio (Duty) can enhance not only the grade on the transferability at the recessed portion, but also the grade on the electric discharge.

As can be understood from these results, when using the recording medium that necessitates a relatively high Vpp, reducing the duty ratio (Duty) can reduce the risk of electric discharge at the transfer peak (Vt) side. As for the recording medium that can obtain a desired transferability at the recessed portion and the electric discharge with a relatively low Vpp, increasing the duty ratio (Duty) can reduce the risk of electric discharge at the return peak (Vr).

In other words, in addition to the configuration of Embodiment 1, adding a configuration for reducing the duty ratio (Duty) as the peak-to-peak voltage Vpp increases can enhance the grade on the transferability at the recessed portion as well as the grade on the electric discharge, as compared with the results of Embodiment 1. The transferability increases so that adequate image density is obtained both at the recessed portion and the projecting portion of the recording medium p, suppressing generation of the white spots and hence obtaining a desired image quality.

Embodiment 5

With reference to FIG. 23, a description is provided of Embodiment 5. In the present illustrative embodiment, the output voltage of the power source 39 is controlled with new additional parameters added to the parameters of Embodiment 2. According to the present illustrative embodiment, as the temperature and/or the humidity detected by the environment detector 52 decreases, the power source 39 is controlled to reduce the duty ratio (Duty) expressed by A/(A+B). In the meantime, as the difference (Vpp) between the maximum voltage and the minimum voltage during transfer increases, the power source 39 is controlled to reduce the duty ratio (Duty). The results are shown in FIG. 23.

In a comparative example shown in FIG. 23, the duty ratio (Duty) is not changed even when the peak-to-peak voltage Vpp and the time-averaged value Vave are changed as the temperature and/or the humidity changes. By contrast, in the illustrative embodiment, the duty ratio (Duty) is changed as the temperature and/or the humidity changes.

In the comparative example, the lower is the temperature and/or the humidity, the higher is the electric resistance of the recording medium. Thus, the peak-to-peak voltage Vpp and the time-averaged value Vave required during transfer increase. However, only increasing the peak-to-peak voltage Vpp and the time-averaged value Vave causes a risk of electric discharge at the transfer peak (Vt) side, and thus the grade on the electric discharge remains low.

By contrast, according to the illustrative embodiment, the higher is the peak-to-peak voltage Vpp, the lower is the duty ratio (Duty), thereby enhancing the grade on the electric discharge. This is because the risk of electric discharge at the transfer peak (Vt) side is decreased.

On the other hand, the higher is the temperature and/or the humidity, the lower is the electric resistance of the recording medium P. Thus, the peak-to-peak voltage Vpp and the time-averaged value of the voltage Vave required during transfer decrease. At this time, only reducing the peak-to-peak voltage Vpp and the time-averaged value Vave causes a risk of electric discharge at the return peak (Vr) side. However, by increasing the duty ratio (Duty) as the temperature and/or humidity increases, it is possible to reduce the risk of electric discharge at the return peak Vr side.

In other words, in addition to the control performed in Embodiment 2, reducing the duty ratio (Duty) as the peak-to-peak voltage Vpp increases can enhance the grade on the transferability at the recessed portion as well as the grade on the electric discharge, as compared with the results of Embodiment 2. The transferability increases so that adequate image density is obtained both at the recessed portion and the projecting portion of the recording medium P, suppressing generation of the white spots and hence obtaining a desired image quality.

Embodiment 6

With reference to FIG. 24, a description is provided of Embodiment 6. In the present illustrative embodiment, the output voltage of the power source 39 is controlled with new additional parameters added to the parameters of Embodiment 3. According to the present illustrative embodiment, as the electrical resistance detected by the resistance detector 53 increases, the power source 39 is controlled to reduce the duty ratio (Duty) expressed by "A/(A+B)". In the meantime, as the difference (Vpp) between the maximum voltage and the minimum voltage during transfer increases, the power source 39 is controlled to reduce the duty ratio (Duty). The results are shown in FIG. 24.

In a comparative example shown in FIG. 24, the higher is the resistance of parts, the more are the peak-to-peak voltage Vpp and the time-averaged value Vave required during transfer. However, only increasing the peak-to-peak voltage Vpp and the time-averaged value Vave causes a risk of electric discharge at the transfer peak (Vt) side.

By contrast, according to the present illustrative embodiment, the greater is the peak-to-peak voltage Vpp, the lower is the duty ratio (Duty), thereby enhancing significantly the grade on the electric discharge, as compared with the comparative example. This is because the risk of electric discharge at the transfer peak (Vt) side is reduced.

On the other hand, the lower is the resistance of parts, the lower are the peak-to-peak voltage Vpp and the time-averaged value Vave required during transfer. At this time, however, when only reducing the peak-to-peak voltage Vpp and the time-averaged value Vave causes an electric discharge at the return peak (Vr) side. In view of the above, by increasing the duty ratio (Duty) as the peak-to-peak voltage Vpp decreases, it is possible to reduce the risk of electric discharge at the return peak Vr side.

In other words, in addition to the control performed in Embodiment 3, reducing the duty ratio (Duty) as the peak-to-peak voltage Vpp increases can enhance the grade on the transferability at the recessed portion as well as the grade on the electric discharge, as compared with the results of Embodiment 3. The transferability increases so that adequate image density is obtained both at the recessed portion and the projecting portion of the recording medium p, suppressing generation of the white spots and hence obtaining a desired image quality.

According to Embodiment 2 described above, as the temperature and/or humidity detected by the environment detector 52 decreases, the controller 60 controls the power source 39 to reduce the duty ratio (Duty) expressed by "A/(A+B)". In addition to this control, as the roughness of the recording medium P selected by the selection device 51 increases, the controller 60 may control the power source 39 to reduce the duty ratio (Duty).

According to Embodiment 3 described above, as the electrical resistance detected by the resistance detector 53 increases, the controller 60 controls the power source 39 to reduce the duty ratio (Duty) expressed by "A/(A+B)". In addition to this control, as the roughness of the recording medium P selected by the selection device 51 increases, the controller 60 may control the power source 39 to reduce the duty ratio (Duty).

The illustrative embodiments of the present disclosure can be applied to an image forming apparatus using a drum-shaped intermediate transfer member in place of the belt-type intermediate transfer member, i.e., the intermediate transfer belt 31. Furthermore, the illustrative embodiments of the present disclosure can be applied to an image forming apparatus using a belt-type nip forming member in place of the nip forming roller 36.

Furthermore, the illustrative embodiments of the present disclosure can be applied to an image forming apparatus using a direct transfer method in which a transfer roller contacts directly a photosensitive drum to form a transfer nip, and a toner image formed on the photosensitive drum is transferred onto a recording medium in the transfer nip by a transfer voltage output by a power source controlled by a controller.

According to an aspect of this disclosure, the present invention is employed in the image forming apparatus. The image forming apparatus includes, but is not limited to, an electrophotographic image forming apparatus, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present disclosure, and all such modifications as would be obvious to one skilled in the art are intended to be included within the scope of the following claims.

What is claimed is:

1. An image forming apparatus, comprising:

an image bearing member to bear a toner image on a surface thereof;

a transfer member disposed opposite the image bearing member to contact the surface of the image bearing member to form a transfer nip;

a power source to output a voltage to transfer the toner image from the image bearing member onto a recording medium interposed in the transfer nip, the voltage including a first voltage in a transfer direction in which the toner image is transferred from the image bearing member to the recording medium and a second voltage having a polarity opposite that of the first voltage, and the first voltage and the second voltage alternating upon transfer of the toner image from the image bearing member to the recording medium; and a controller operatively connected to the power source to control the power source, wherein a time-averaged value of the voltage has a polarity in the transfer direction, and an absolute value of the time-averaged value of the voltage is greater than a midpoint value of the voltage, the midpoint value of the voltage being an intermediate value between a maximum value and a minimum value of the voltage and the time-averaged value of the voltage being a value of an integral value of an alternating waveform of the voltage over one cycle divided by a length of said one cycle, and wherein as a roughness of the recording medium increases, the controller controls the power source to reduce a duty ratio expressed by A/(A+B), where A is an area of the alternating waveform of the voltage in said one cycle in a return direction opposite the transfer direction relative to the midpoint value of the voltage and B is an area of the alternating waveform of the voltage in the transfer direction relative to the midpoint value of the voltage.

2. The image forming apparatus according to claim 1, further comprising a selection device to select a type of the recording medium, wherein the controller controls the power source to reduce the duty ratio as the roughness of the recording medium selected by the selection device increases.

3. The image forming apparatus according to claim 1, further comprising an environment detector to detect at least one of temperature and humidity, wherein the controller controls the power source to reduce the duty ratio as at least one of the temperature and the humidity decreases.

4. The image forming apparatus according to claim 1, further comprising a resistance detector to detect an electrical resistance of a transfer section including the image bearing member and the transfer member, wherein the controller controls the power source to reduce the duty ratio as an electrical resistance detected by the resistance detector increases.

5. The image forming apparatus according to claim 1, wherein as a difference between the maximum value and the minimum value of the voltage increases upon transfer of the toner image, the controller controls the power source to reduce the duty ratio.

6. An image forming apparatus, comprising:

an image bearing member to bear a toner image on a surface thereof;

a transfer member disposed opposite the image bearing member to contact the surface of the image bearing member to form a transfer nip;

a power source to output a voltage to transfer the toner image on the image bearing member onto a recording medium interposed in the transfer nip, the voltage including a first voltage in a transfer direction in which the toner image is transferred from the image bearing member to the recording medium and a second voltage having a polarity opposite that of the first voltage, and the first voltage and the second voltage alternating upon transfer of the toner image from the image bearing member to the recording medium;

a controller operatively connected to the power source to control the power source; and an environment detector to detect at least one of temperature and humidity, wherein a time-averaged value of the voltage has a polarity in the transfer direction, and an absolute value of the time-averaged value of the voltage is greater than a midpoint value of the voltage, the midpoint value of the voltage being an intermediate value between a maximum value and a minimum value of the voltage and the time-averaged value of the voltage being a value of an integral value of an alternating waveform of the voltage over one cycle divided by a length of said one cycle, and wherein as the at least one of the temperature and the humidity detected by the environment detector decreases, the controller controls the power source to reduce a duty ratio expressed by A/(A+B), where A is an area of the alternating waveform of the voltage in said one cycle in a return direction opposite the transfer direction relative to the midpoint value of the voltage and B is an area of the alternating waveform of the voltage in the transfer direction relative to the midpoint value of the voltage.

7. The image forming apparatus according to claim 6, wherein as a difference between the maximum value and the minimum value of the voltage increases upon transfer of the toner image, the controller controls the power source to reduce the duty ratio.

8. An image forming apparatus, comprising:

an image bearing member to bear a toner image on a surface thereof;

a transfer member disposed opposite the image bearing member to contact the surface of the image bearing member to form a transfer nip;

a power source to output a voltage to transfer the toner image on the image bearing member onto a recording medium interposed in the transfer nip, the voltage including a first voltage in a transfer direction in which the toner image is transferred from the image bearing member to the recording medium and a second voltage having a polarity opposite that of the first voltage, and the first voltage and the second voltage alternating upon transfer of the toner image from the image bearing member to the recording medium;

a controller operatively connected to the power source to control the power source; and a resistance detector to detect an electrical resistance of a transfer section including the image bearing member and the transfer member, wherein a time-averaged value of the voltage has a polarity in the transfer direction, and an absolute value of the time-averaged value of the voltage is greater than a midpoint value of the voltage, the midpoint value of the voltage being an intermediate value between a maximum value and a minimum value of the voltage and the time-averaged value of the voltage being a value of an integral value of an alternating waveform of the voltage over one cycle divided by a length of said one cycle, and wherein as an electrical resistance detected by the resistance detector increases, the controller controls the power source to reduce a duty ratio expressed by A/(A+B), where A is an area of the alternating waveform of the voltage in said one cycle in a return direction opposite the transfer direction relative to the midpoint value of the voltage and B is an area of the alternating waveform of the voltage in the transfer direction relative to the midpoint value of the voltage.

9. The image forming apparatus according to claim 8, wherein as a difference between the maximum value and the minimum value of the voltage increases upon transfer of the toner image, the controller controls the power source to reduce the duty ratio.

10. The image forming apparatus according to claim 1, wherein each of the image bearing member and the transfer member includes a metal cored bar on which a conductive nitrile rubber is disposed.

11. The image forming apparatus according to claim 10, wherein electrical resistance of an electrical path between the metal cored bar of the image bearing member and the metal cored bar of the transfer member is detected by a resistance detector.

12. The image forming apparatus according to claim 1, wherein the power source includes a direct current power source and an alternating current power source and outputs a superimposed bias as the voltage in which an alternating current voltage is superimposed on a direct current voltage.

13. The image forming apparatus according to claim 1, wherein the alternating waveform of the voltage is at least one of a trapezoid waveform, a triangular waveform, and a square waveform.

* * * * *